US011721938B1

(12) United States Patent
Crunk

(10) Patent No.: US 11,721,938 B1
(45) Date of Patent: Aug. 8, 2023

(54) ELECTRICAL PLUG RETAINING ASSEMBLY

(71) Applicant: David J. Crunk, Southgate, MI (US)

(72) Inventor: David J. Crunk, Southgate, MI (US)

( * ) Notice: Subject to any disclaimer, the term of this patent is extended or adjusted under 35 U.S.C. 154(b) by 0 days.

(21) Appl. No.: 17/485,445

(22) Filed: Sep. 26, 2021

(51) Int. Cl.
*H01R 13/629* (2006.01)
*H01R 13/639* (2006.01)
*H01R 25/00* (2006.01)

(52) U.S. Cl.
CPC ..... *H01R 13/6395* (2013.01); *H01R 13/629* (2013.01); *H01R 25/006* (2013.01)

(58) Field of Classification Search
CPC ..... H01R 13/6395; H01R 13/629; H01R 25/006; H01R 13/6397; H01R 13/44; H01R 13/447; H01R 13/20
See application file for complete search history.

(56) References Cited

U.S. PATENT DOCUMENTS 4,932,886 A * 6/1990 Glaser ..... H01R 13/6395 439/342
4,952,755 A * 8/1990 Engel ..... H01R 13/447 174/67
5,641,298 A * 6/1997 Holloway ..... H01R 13/6395 439/346
6,875,040 B1 * 4/2005 O'Keefe ..... H01R 13/6392 439/369
7,077,683 B1 * 7/2006 Ross ..... H01R 13/6395 439/346
7,595,449 B1 * 9/2009 Dyderski ..... H02G 3/14 174/67
8,187,012 B1 * 5/2012 Baldwin ..... H01R 13/453 439/137
2015/0064960 A1 * 3/2015 Chapel ..... H01R 13/5804 439/373

* cited by examiner

*Primary Examiner* — Tho D Ta
(74) *Attorney, Agent, or Firm* — Buckert Patent & Trademark Law Firm PC; John F. Buckert

(57) ABSTRACT

An electrical plug retaining assembly is provided. The assembly includes a first electrical plug socket adapted to receive first and second electrical prongs of a first electrical plug therein when first and second retaining arm assemblies in the first electrical plug socket are depressed. The first electrical plug socket secures the first and second electrical prongs of the first electrical plug therein when first and second springs in the first electrical plug socket bias the first and second retaining arm assemblies, respectively, thereof in first and second directions, respectively, when the first and second retaining arm assemblies in the first electrical plug socket are not depressed. The first electrical plug socket has first and second electrical terminals that are electrically coupled to the first and second electrical prongs, respectively, of the first electrical plug.

17 Claims, 47 Drawing Sheets

ELECTRICAL PLUG RETAINING ASSEMBLY

BACKGROUND

Small children can undesirably play with electrical plugs that are coupled to a wall outlet and can sometimes be electrically shocked when doing so.

The inventor herein has recognized a need for an improved electrical plug retaining assembly that is secured to a wall outlet to reduce and/or eliminate the above-mentioned problem.

SUMMARY

An electrical plug retaining assembly in accordance with an exemplary embodiment is provided. The electrical plug retaining assembly includes a first electrical plug socket adapted to receive first and second electrical prongs of a first electrical plug therein when first and second retaining arm assemblies in the first electrical plug socket are depressed. The first electrical plug socket secures the first and second electrical prongs of the first electrical plug therein when first and second springs in the first electrical plug socket bias the first and second retaining arm assemblies, respectively, thereof in first and second directions, respectively, when the first and second retaining arm assemblies in the first electrical plug socket are not depressed. The first electrical plug socket has first and second electrical terminals that are electrically coupled to the first and second electrical prongs, respectively, of the first electrical plug. The electrical plug retaining assembly further includes a second electrical plug socket adapted to receive first and second electrical prongs of a second electrical plug therein when first and second retaining arm assemblies in the second electrical plug socket are depressed. The second electrical plug socket secures the first and second electrical prongs of the second electrical plug therein when first and second springs in the second electrical plug socket bias the first and second retaining arm assemblies, respectively, thereof in the first and second directions, respectively, when the first and second retaining arm assemblies in the second electrical plug socket are not depressed. The second electrical plug socket has first and second electrical terminals that are electrically coupled to the first and second electrical prongs, respectively, of the second electrical plug. The electrical plug retaining assembly further includes a rear support plate assembly adapted to hold the first and second electrical plug sockets thereon such that the first and second electrical terminals of the first electrical plug socket extend therethrough, and the first and second electrical terminals of the second electrical plug socket extend therethrough. The electrical plug retaining assembly further includes a front cover plate that is coupled to the rear support plate assembly to hold the first and second electrical plug sockets therebetween.

An electrical plug socket in accordance with another exemplary embodiment is provided. The electrical plug socket includes a housing, first and second retaining arm assemblies, first and second springs, and first and second electrical terminals. The housing has first and second grooves therein and first and second prong apertures extending therethrough. The first electrical terminal has a first female terminal portion and a first male terminal portion coupled together. The first female terminal portion is disposed in the first groove and has first and second holes extending therethrough. The first male terminal portion extends outwardly from the housing. The first female terminal portion is aligned with the first prong aperture. The second electrical terminal has a second female terminal portion and a second male terminal portion coupled together. The second female terminal portion is disposed in the second groove and has first and second holes extending therethrough. The second male terminal portion extends outwardly from the housing. The second female terminal portion is aligned with the second prong aperture. The first retaining arm assembly is slidably disposed on the housing and extends over the first and second female terminal portions. The first retaining arm assembly has a first pin. The first spring contacts the housing and the first retaining arm assembly and biases the first retaining arm assembly in a first direction to move the first pin through the first and second holes of the first female terminal portion when the first retaining arm assembly is not depressed. The second retaining arm assembly is slidably disposed on the housing and extends over the first and second female terminal portions. The second retaining arm assembly has a second pin. The second spring contacts the housing and the second retaining arm assembly biases the second retaining arm assembly in a second direction to move the second pin through the first and second holes of the second female terminal portion when the second retaining arm assembly is not depressed.

DETAILED DESCRIPTION

Referring to FIGS. 1-8, an electrical plug retaining assembly 20 in accordance with an exemplary embodiment is illustrated. The electrical plug retaining assembly 20 is configured to receive the electrical plug 22 therein and to selectively hold the electrical plug 22 therein. Further, the electrical plug retaining assembly 20 is configured to be plugged into a wall outlet 24 (shown in FIG. 6) and to be fixedly held to the wall outlet 24.

Figure 7:
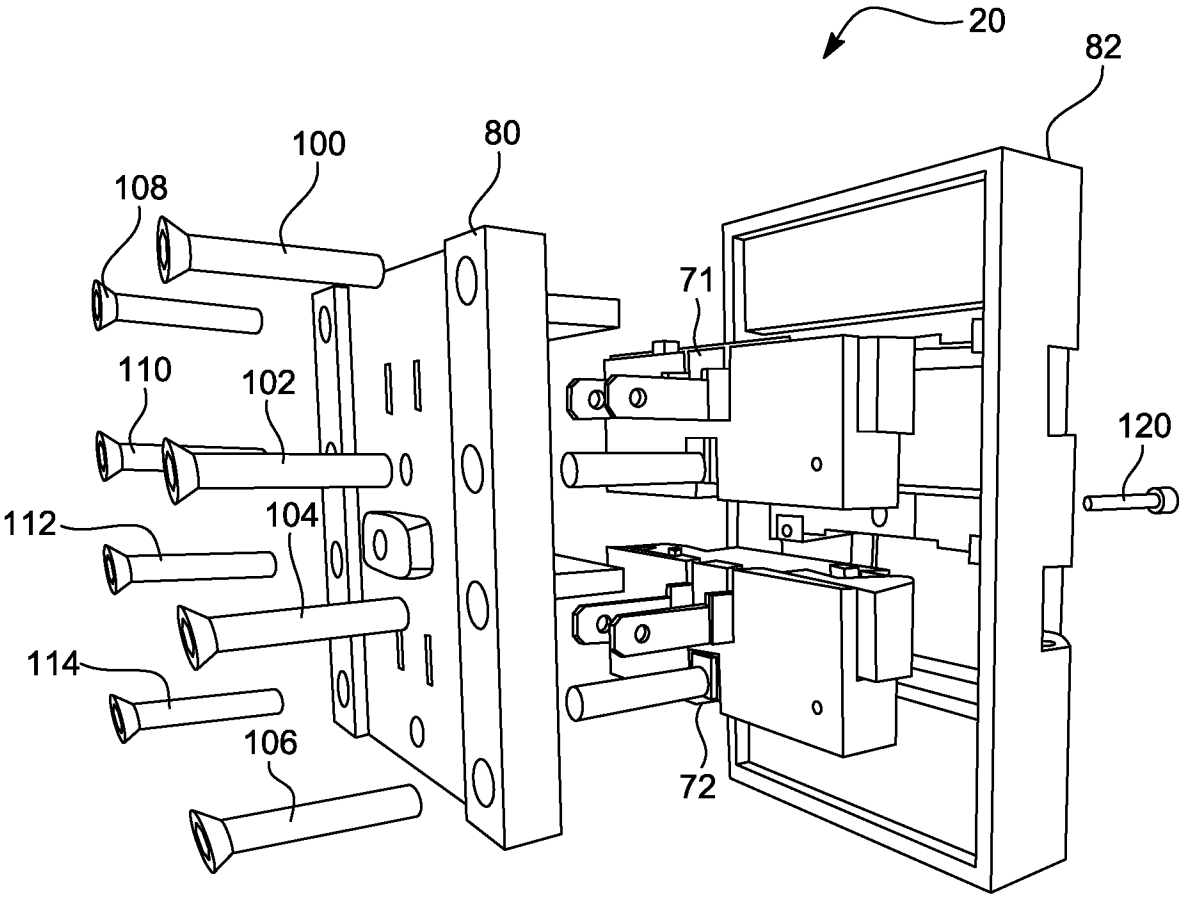
FIG. 7 is an exploded view of the electrical plug retaining assembly of FIG. 1.
Figure 8:
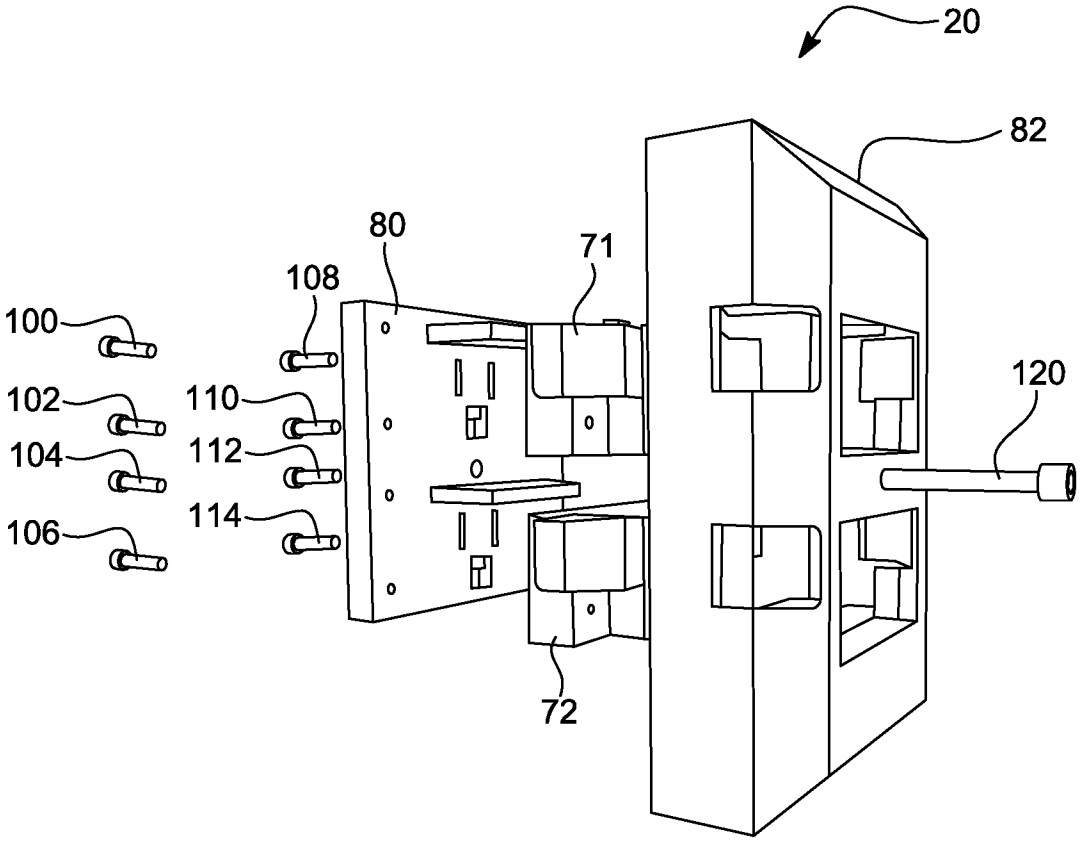
FIG. 8 is another exploded view of the electrical plug retaining assembly of FIG. 7.
Figure 9:
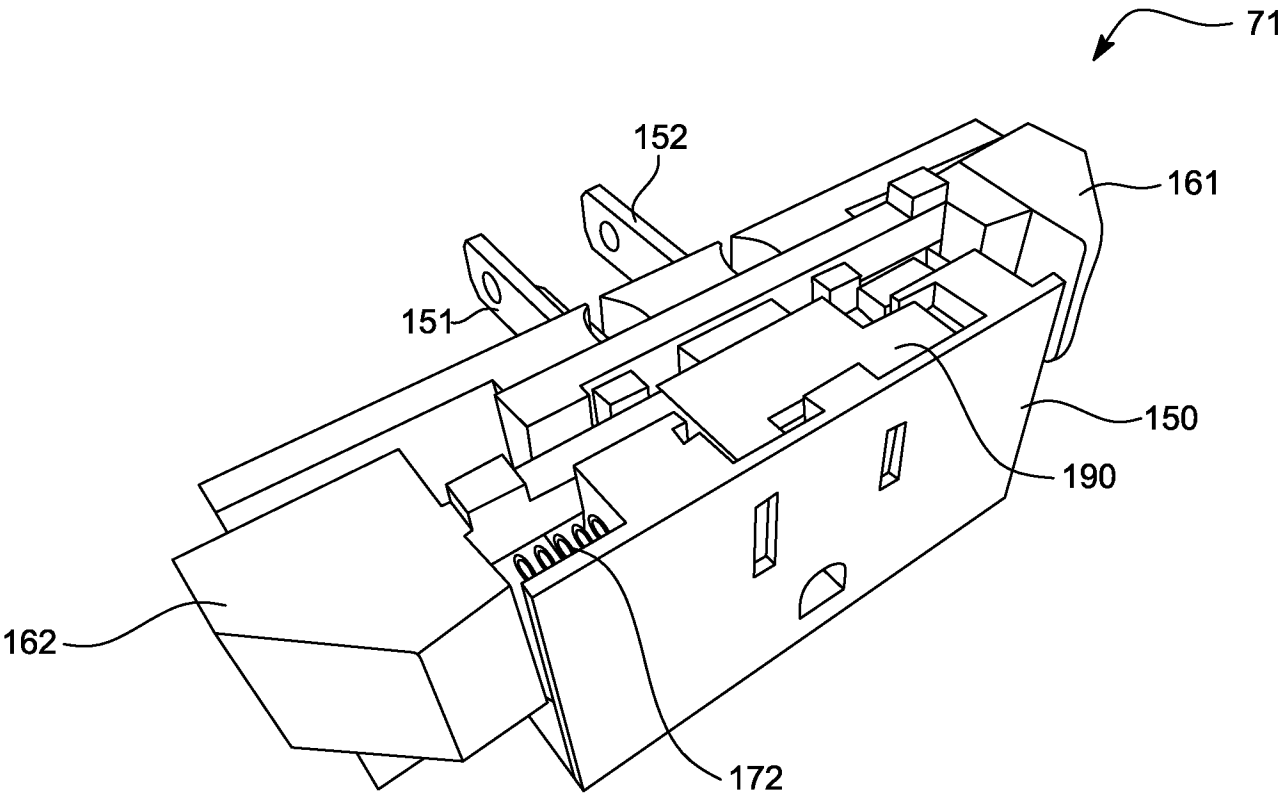
FIG. 9 is a schematic of a first electrical plug socket utilized in the electrical plug retaining assembly of FIG. 1.
Figure 10:
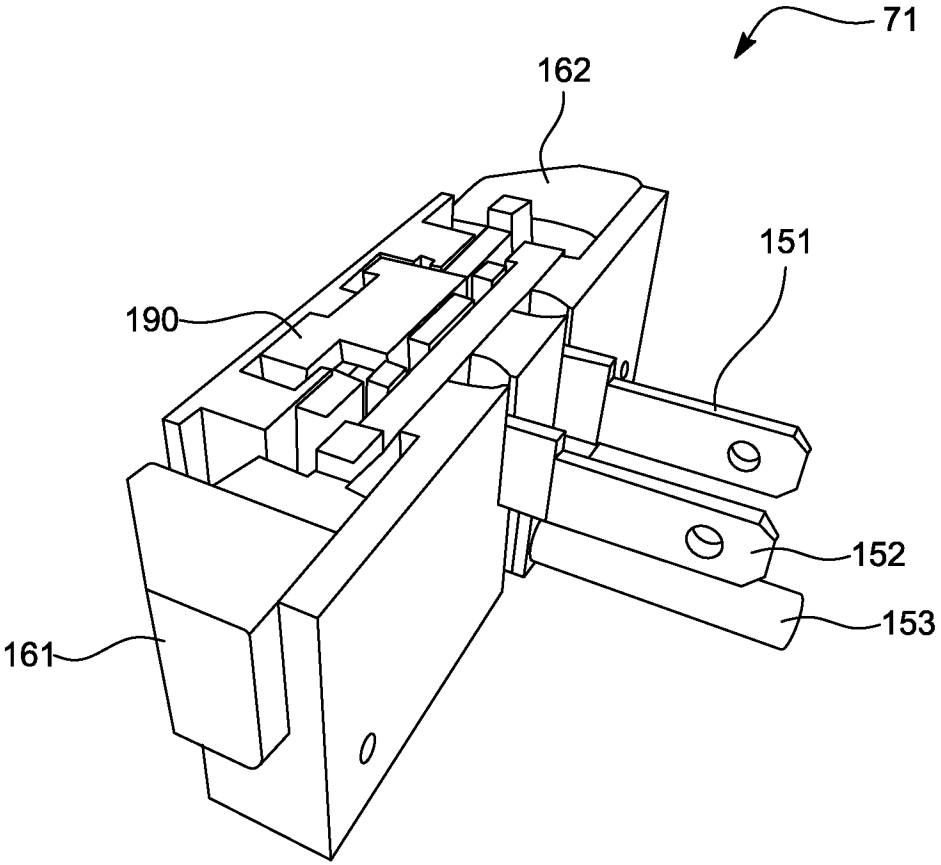
FIG. 10 is another schematic of the first electrical plug socket of FIG. 9.
Figure 11:
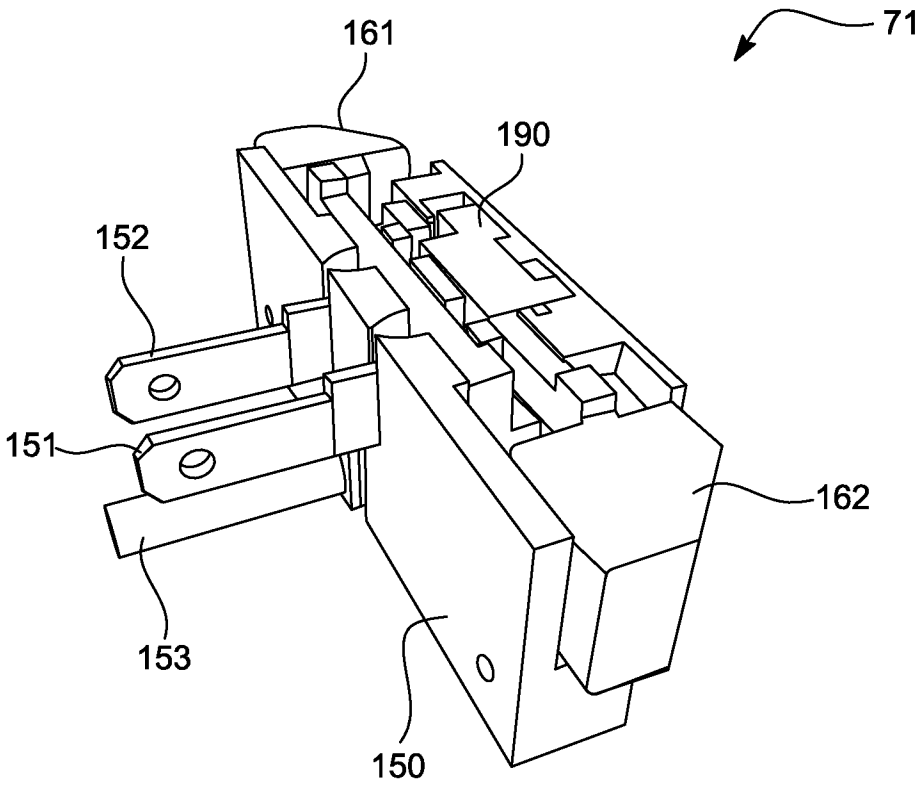
FIG. 11 is another schematic of the first electrical plug socket of FIG. 9.
Figure 12:
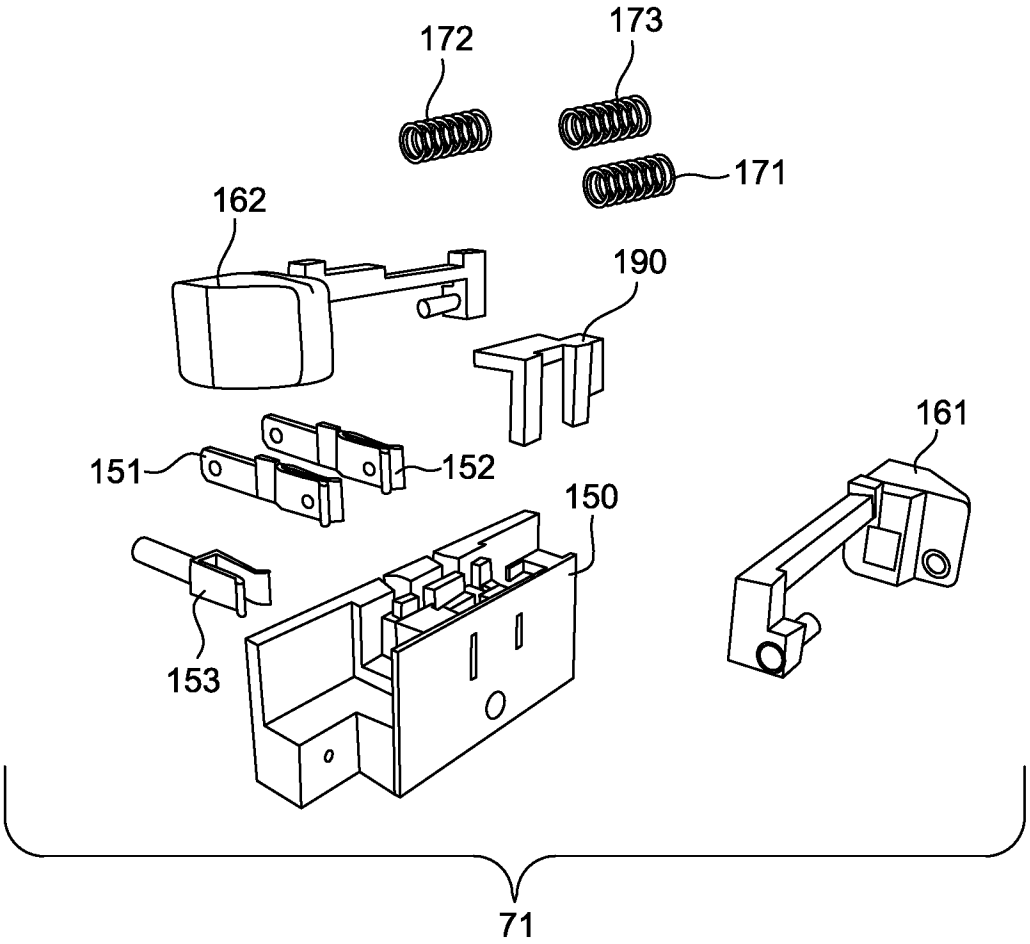
FIG. 12 is an exploded view of the first electrical plug socket of FIG. 9.
Figure 13:
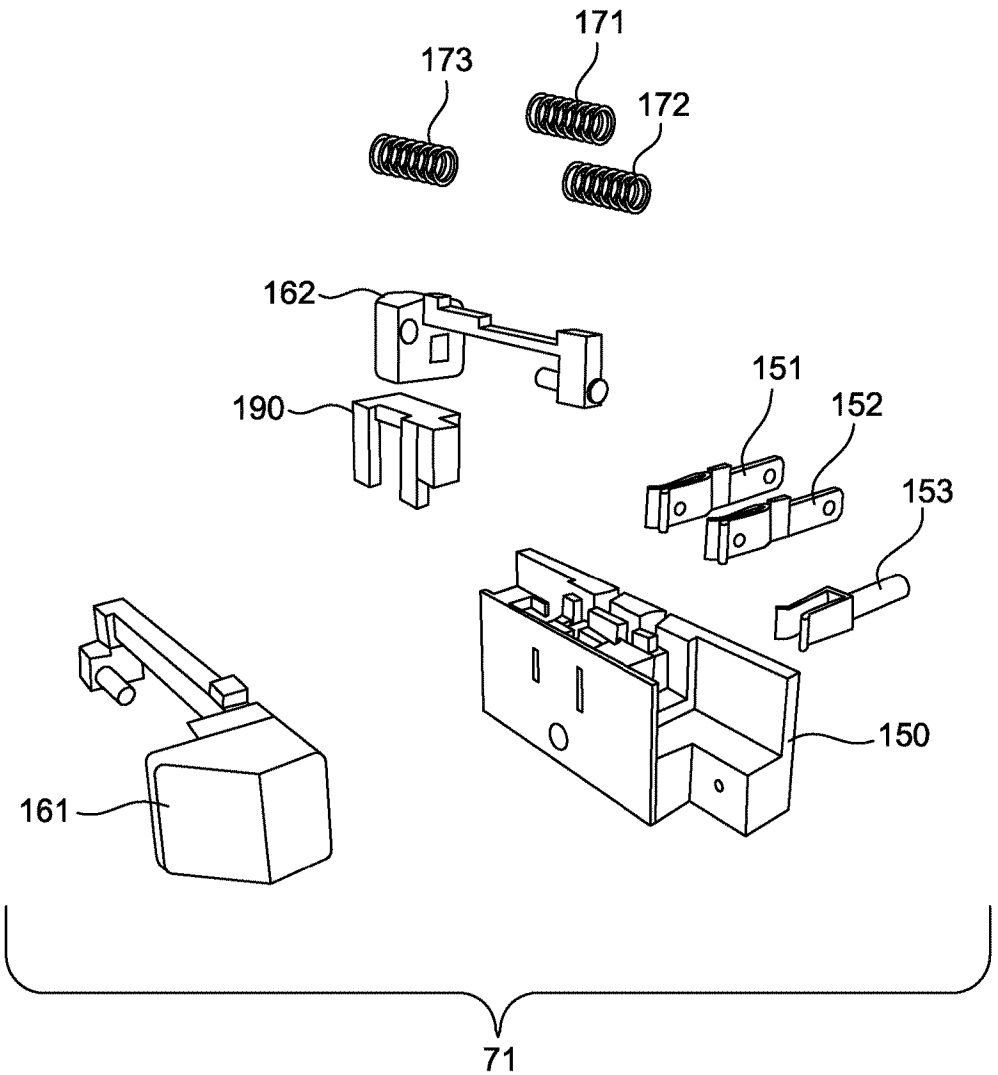
FIG. 13 is another exploded view of the first electrical plug socket of FIG. 9.

Referring to FIGS. 7 and 8, the electrical plug retaining assembly 20 includes an electrical plug socket 71, an electrical plug socket 72, a rear support plate assembly 80, a front cover plate 82, bolts 100, 102, 104, 106, 108, 110, 112, 114, and a bolt 120.

Referring to FIGS. 1 and 7-18, the electrical plug socket 71 is coupled to the rear support plate assembly 80. The electrical plug socket 71 receives first and second electrical prongs 2001, 2002 (shown in FIG. 1) of an electrical plug 22 therein when first and second retaining arm assemblies 161, 162 in the electrical plug socket 71 are depressed. The electrical plug socket 71 secures the first and second electrical prongs 2001, 2002 of the electrical plug 71 therein when first and second springs 171, 172 in the electrical plug socket 71 bias the first and second retaining arm assemblies 161, 162, respectively, thereof in first and second directions, respectively, when the first and second retaining arm assemblies 161, 162 in the electrical plug socket 71 are not depressed. The electrical plug socket 71 includes a housing 150, a first electrical terminal 151, a second electrical terminal 152, a third electrical terminal 153, a first retaining arm assembly 161, a second retaining arm assembly 162, a first spring 171, a second spring 172, a third spring 173, and a prong hole cover member 190.

Referring to FIGS. 19-23, the housing 150 is provided to hold the remaining components of the electrical socket 71 thereon. The housing 150 includes a front wall 250, a central support portion 252, and a rear wall 254. The central support portion 252 is disposed between the front wall 250 and the rear wall 254 and is integrally formed with the front wall 250 and the rear wall 254. In an exemplary embodiment, the housing 150 extends along a longitudinal axis 255 (shown in FIG. 19) and is constructed of plastic.

Figure 21:
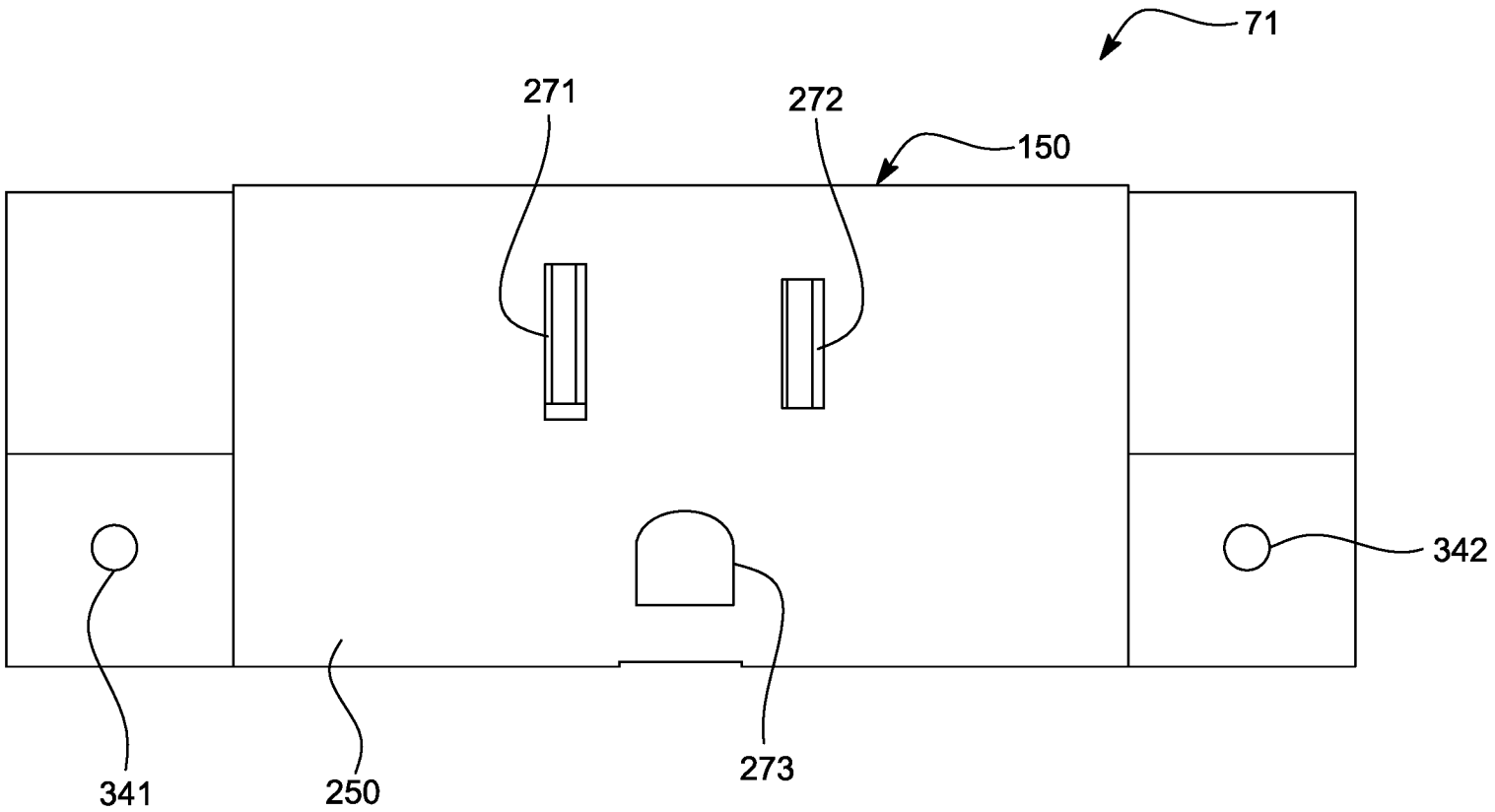
FIG. 21 is a front view of the housing of FIG. 19.

Referring to FIG. 21, the front wall 250 includes prong apertures 271, 272, 273 extending therethrough.

Figure 19:
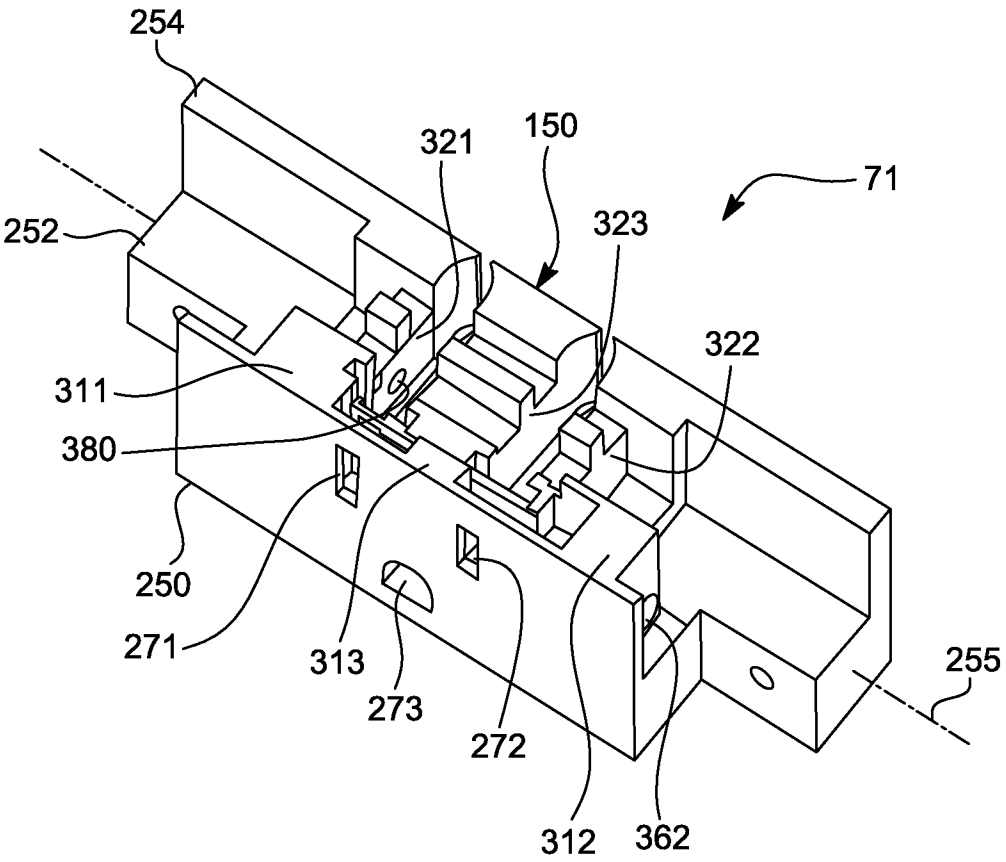
FIG. 19 is a schematic of a housing utilized in the first electrical plug socket of FIG. 9.
Figure 20:
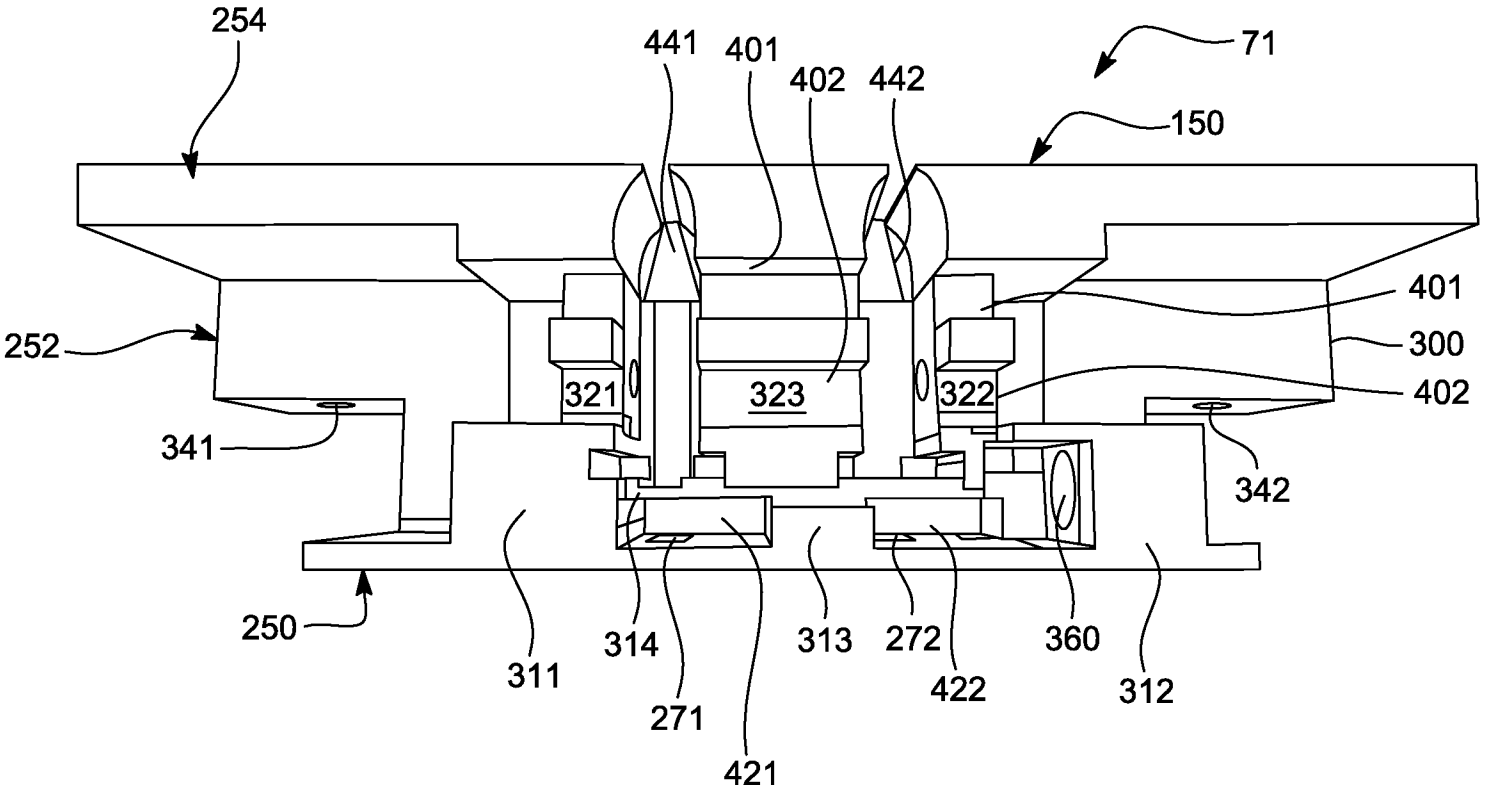
FIG. 20 is a top view of the housing of FIG. 19.

Referring to FIG. 20, the central support portion 252 includes a t-shaped portion 300, a first front vertical portion 311, a second front vertical portion 312, a third front vertical portion 313, an intermediate wall portion 314, a first rear vertical portion 321 (shown in FIGS. 19 and 22), a second rear vertical portion 322, and a third rear vertical portion 323.

Figure 23:
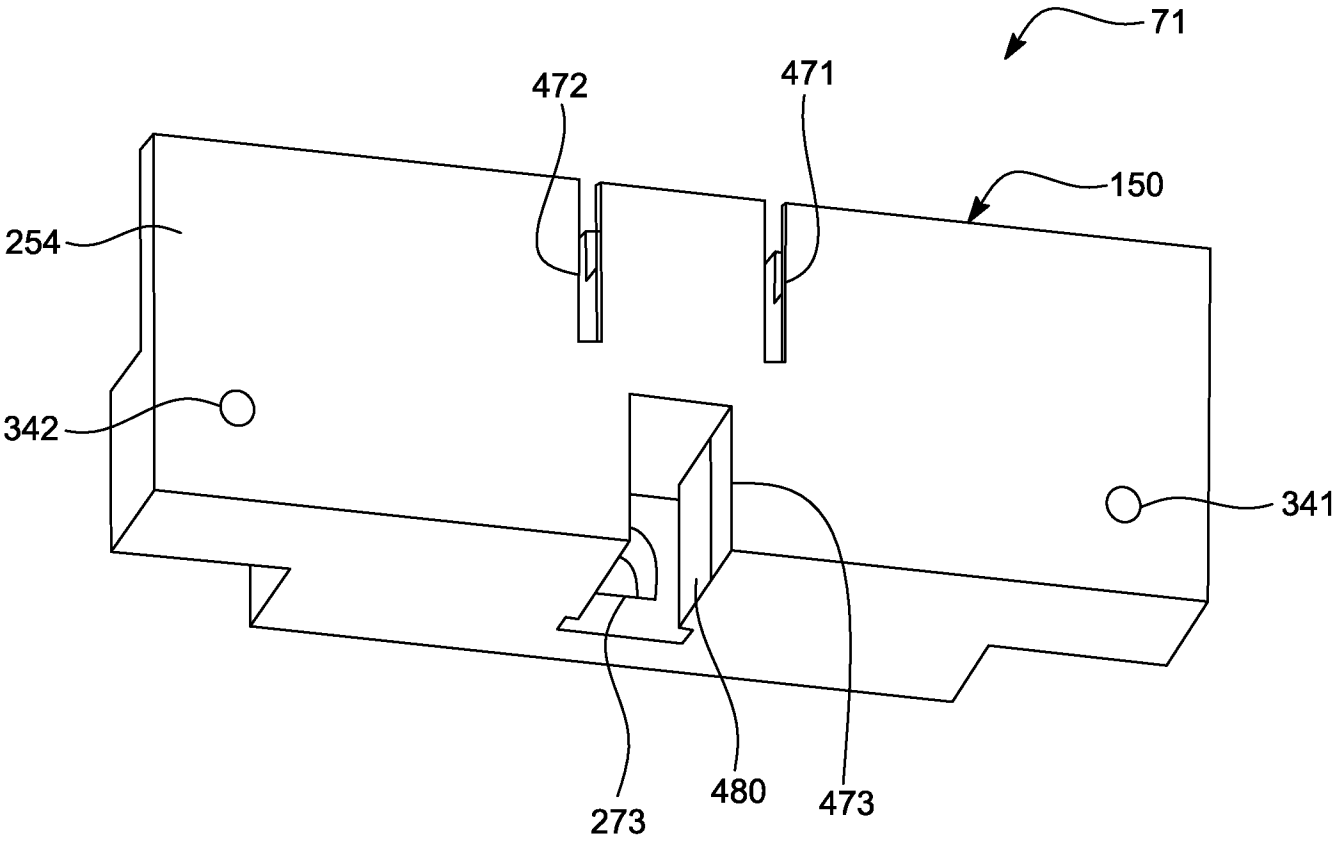
FIG. 23 is another schematic of the housing of FIG. 19.
Figure 25:
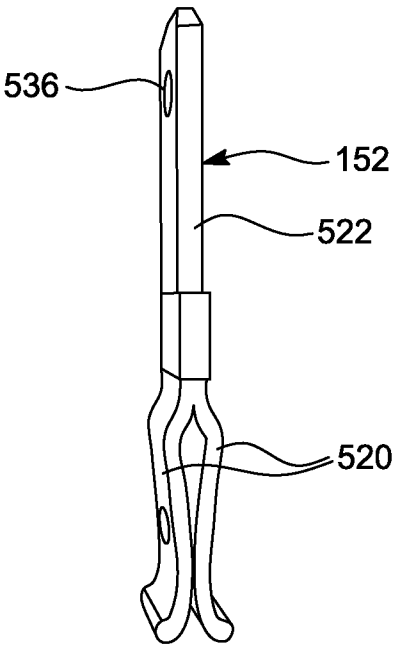
FIG. 25 is a schematic of a second electrical terminal utilized in the first electrical plug socket of FIG. 9.

Referring to FIGS. 20 and 23, the t-shaped portion 300 includes apertures 341, 342 disposed on opposite ends of the t-shaped portion 300 and extending axially therethrough. Further, the t-shaped portion 300 includes a lateral groove 480 extending therethrough that communicates with the prong aperture 273 and the aperture 473.

Referring to FIG. 20, the first, second, third front vertical portions 311, 312, 313 are coupled to and extend upwardly from the t-shaped portion 300. Further, the first, second, third front vertical portions 311, 312, 313 are coupled to and extend inwardly from the front wall 250. Further, the third front vertical portion 313 is disposed between the first and second front vertical portions 311, 312.

Figure 22:
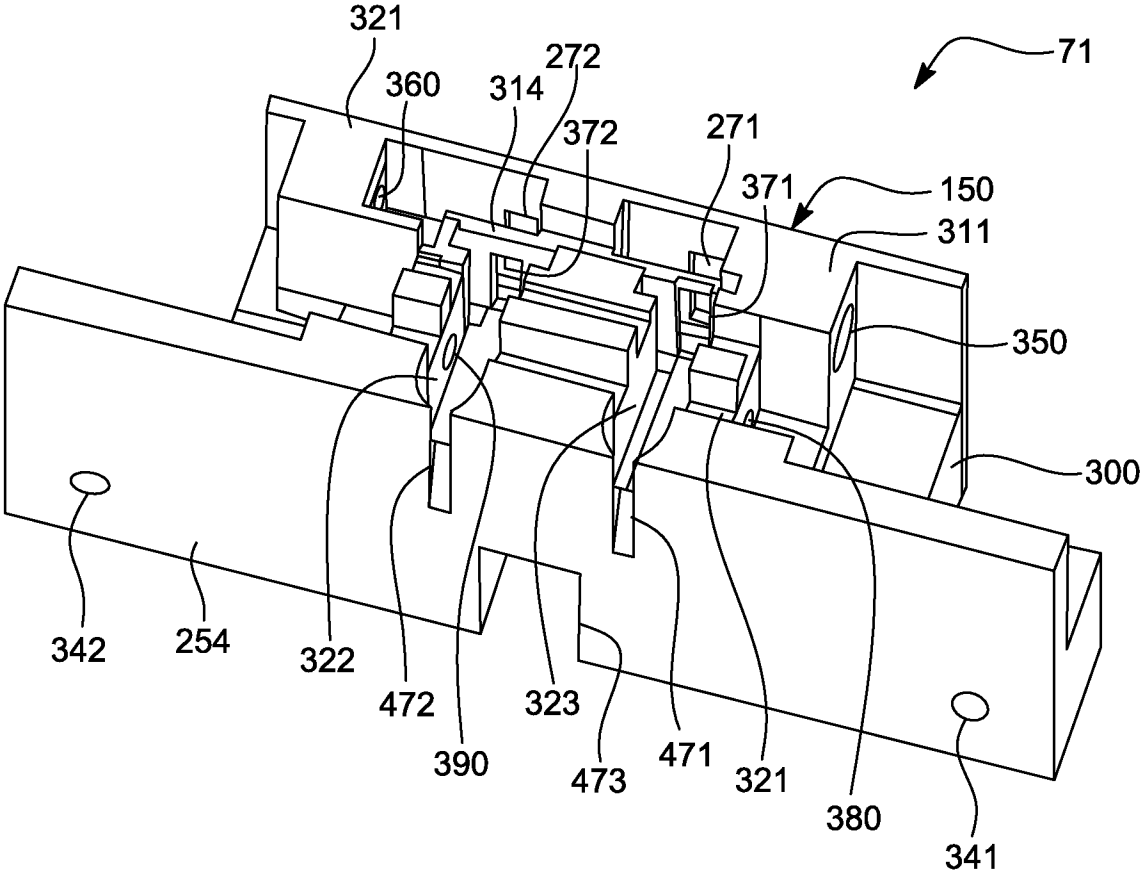
FIG. 22 is another schematic of the housing of FIG. 19.

Referring to FIG. 22, the first front vertical portion 311 includes an aperture 350 extending longitudinally therein.

Referring to FIGS. 20 and 22, the second front vertical portion 312 includes an aperture 360 extending longitudinally therein. Further, the second front vertical portion 312 includes an aperture 362 extending longitudinally therein.

Referring to FIG. 22, the intermediate wall portion 314 is coupled to and extends upwardly from the t-shaped portion 300. The intermediate wall portion 314 includes apertures 371, 372 extending therethrough that are aligned with the prong apertures 271, 272, respectively.

Referring to FIGS. 19 and 22, the first rear vertical portion 321 is coupled to and extends upwardly from the t-shaped portion 300. Further, the first rear vertical portion 321 is disposed between the first front vertical portion 311 and the rear wall 254. The first rear vertical portion 321 includes an aperture 380 extending longitudinally therein.

The second rear vertical portion 322 is coupled to and extends upwardly from the t-shaped portion 300. Further, the second rear vertical portion 322 is disposed between the intermediate wall portion 314 and the rear wall 254. The second rear vertical portion 322 includes an aperture 390 (shown in FIG. 22) extending longitudinally therein.

The third rear vertical portion 322 is coupled to and extends upwardly from the t-shaped portion 300 and is further disposed between the first and second rear vertical portions 321, 322.

Referring to FIG. 20, the longitudinal grooves 401, 402 extend through the first, second, and third rear vertical portions 321, 322, 323. The longitudinal groove 401 slidably receives a portion of the first retaining arm assembly 161 (shown in FIG. 17) therethrough. Further, the longitudinal groove 402 slidably receives a portion of the second retaining arm assembly 162 (shown in FIG. 17) therethrough.

A cavity 421 is formed by the front wall 250, the first front vertical portion 311, the intermediate wall portion 314, and the third front vertical portion 313. The cavity 421 communicates with the prong aperture 271 and the lateral groove 441.

A cavity 422 is formed by the front wall 250, the second front vertical portion 312, the third front vertical portion 313, and the intermediate wall portion 314. The cavity 422 communicates with the prong aperture 272 and the lateral groove 442.

Referring to FIGS. 20 and 22, a lateral groove 441 extends through the central support portion 252 and communicates with the aperture 371 and the aperture 471.

A lateral groove 442 extends through the central support portion 252 and communicates with the aperture 372 and the aperture 472.

Referring to FIGS. 22 and 23, the rear wall 254 is coupled to the t-shaped portion 300 and includes apertures 471, 472, 473 extending therethrough. The aperture 473 communicates with the lateral groove 480 extending through the t-shaped portion 300.

Referring to FIGS. 1, 24, 27 and 31, the first electrical terminal 151 is configured to receive the first electrical prong 2001 (shown in FIG. 1) of the electrical plug 22 therein. The first electrical terminal 151 includes a female terminal portion 500 and a male terminal portion 502 coupled together. The female terminal portion 500 includes holes 511, 512 (shown in FIG. 27) extending therethrough and receives the first electrical prong 2001 therein. The holes 511, 512 of the female terminal portion 500 are aligned with the hole 2011 of the first electrical prong 2001 when the prong 2001 is disposed within the female terminal portion 500. The female terminal portion 500 is disposed in the lateral groove 441 (shown in FIG. 20). Further, the female terminal portion 500 is aligned with the prong aperture 271 in the front wall 250. The male terminal portion 502 includes a hole 516 extending therethrough. The male terminal portion 502 extends through the aperture 471 (shown in FIG. 22) in the rear wall 254 and outwardly from the housing 150. In an exemplary embodiment, the first electrical terminal 151 is constructed of copper.

Referring to FIGS. 1, 25, 28 and 31, the second electrical terminal 152 is configured to receive the second electrical prong 2002 (shown in FIG. 1) of the electrical plug 22 therein. The second electrical terminal 152 includes a female terminal portion 520 and a male terminal portion 522 coupled together. The female terminal portion 520 includes holes 531, 532 (shown in FIG. 28) extending therethrough and receives the second electrical prong 2002 therein. The holes 531, 532 of the female terminal portion 520 are aligned with the hole 2012 of the second electrical prong 2002 when the prong 2002 is disposed within the female terminal portion 520. The female terminal portion 520 is disposed in the lateral groove 442 (shown in FIG. 20). Further, the female terminal portion 520 is aligned with the prong aperture 272 in the front wall 250. The male terminal portion 522 includes a hole 536 extending therethrough. The male terminal portion 522 extends through the aperture 472 (shown in FIG. 22) in the rear wall 254 and outwardly from the housing 150. In an exemplary embodiment, the second electrical terminal 152 is constructed of copper.

Referring to FIGS. 1, 24, 27 and 31, the third electrical terminal 153 is configured to receive the third electrical prong 2003 (shown in FIG. 1) of the electrical plug 22 therein. The third electrical terminal 153 includes a female terminal portion 540 and a male terminal portion 542 coupled together. The female terminal portion 540 receives the third electrical prong 2003 therein. The female terminal portion 540 is disposed in the lateral groove 480 (shown in FIG. 23). Further, the female terminal portion 540 is aligned with the prong aperture 273 in the front wall 250. The male terminal portion 542 extends through the aperture 473 (shown in FIG. 22) in the rear wall 254 and outwardly from the housing 150. In an exemplary embodiment, the third electrical terminal 153 is constructed of copper.

Referring to FIGS. 17 and 30-32, the first retaining arm assembly 161 is slidably disposed on the housing 150 and extends over the female terminal portions 500, 520. The first retaining arm assembly 161 has a finger tab portion 580, a horizontal shaft portion 582, a tab portion 584, a pin holding portion 586, and a pin 588. The horizontal shaft portion 582 is coupled to and between the finger tab portion 580 and the pin holding portion 586. The pin holding portion 586 extends downwardly from the horizontal shaft portion 582. The pin 588 is coupled to the pin holding portion 586 and extends toward the finger tab portion 580. The tab portion 584 is coupled to and extends upwardly from the horizontal shaft portion 582 and is disposed proximate to the finger tab portion 580. The finger tab portion 580 includes an aperture 600 extending therein for receiving the spring 171 (shown in FIG. 17) therein. The horizontal shaft portion 582 is slidably disposed in the longitudinal groove 401 (shown in FIG. 20) on the central support portion 252. Further, the spring 171 is disposed in the aperture 362 (shown in FIG. 19) of the housing 150 and in the aperture 600 (shown in FIG. 30) of the finger tab portion 580 and biases the first retaining arm assembly 161 outwardly (rightward in FIG. 17).

Figure 1:
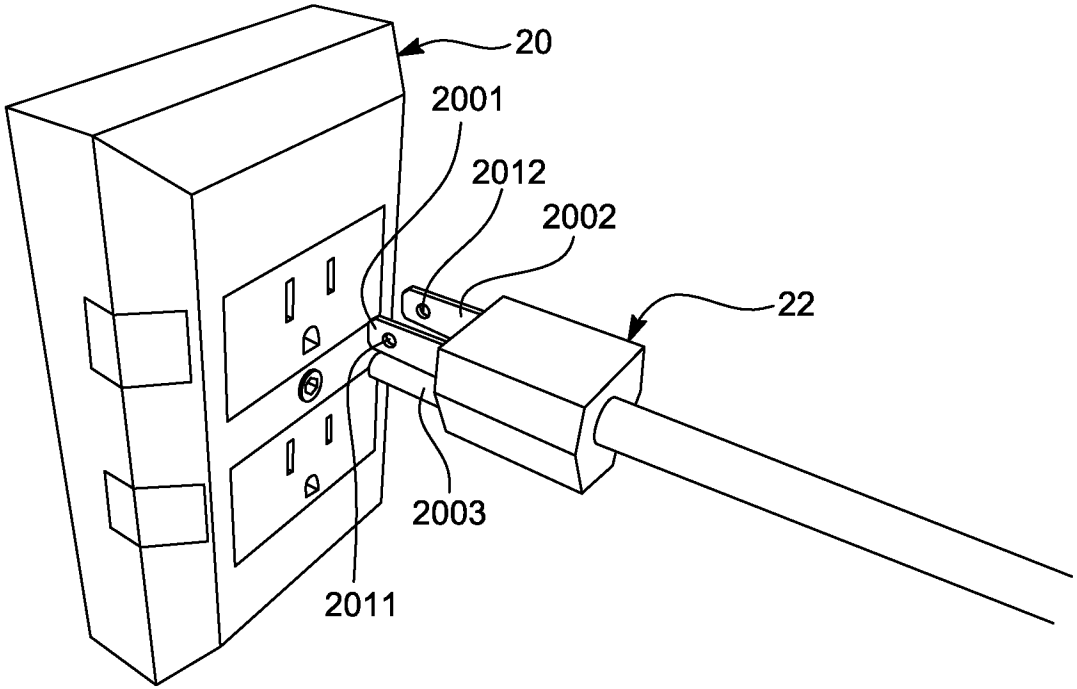
FIG. 1 is a schematic of an electrical plug retaining assembly in accordance with an exemplary embodiment, and an electrical plug prior to being coupled to the assembly.
Figure 2:
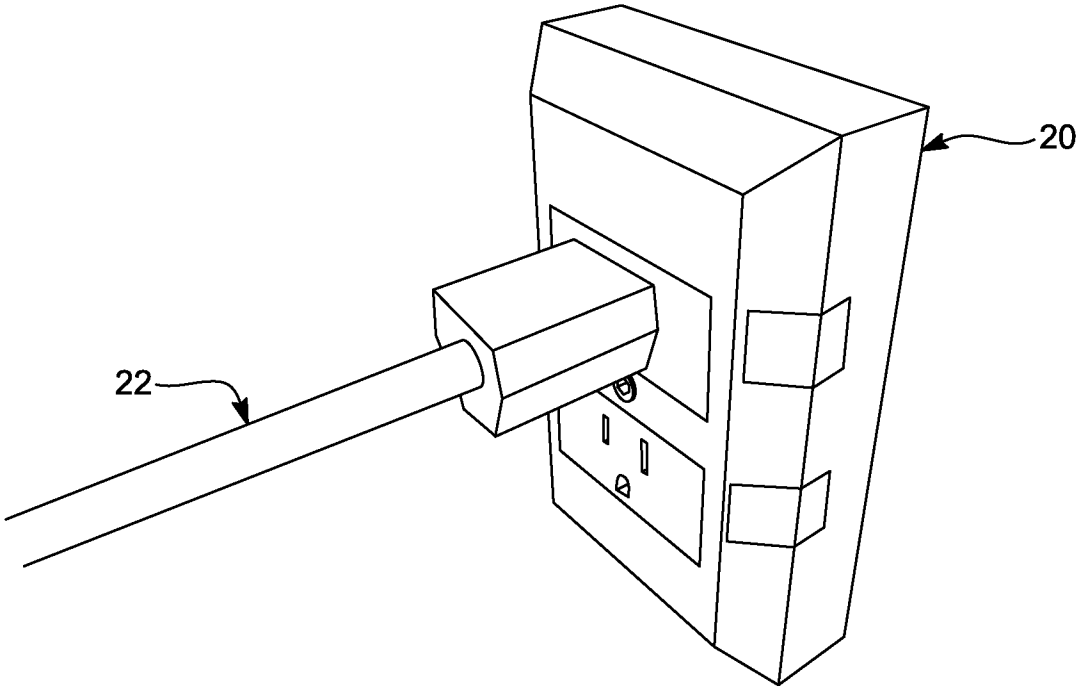
FIG. 2 is another schematic of the electrical plug retaining assembly and the electrical plug of FIG. 1 with the electrical plug coupled to the assembly.
Figure 3:
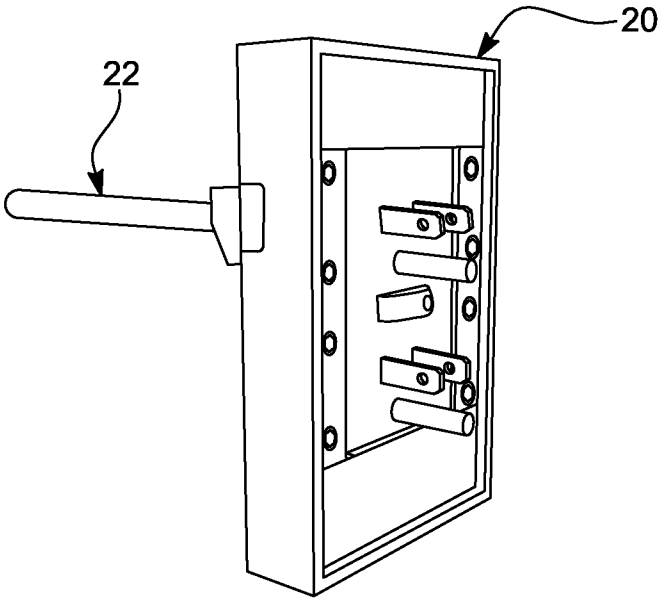
FIG. 3 is another schematic of the electrical plug retaining assembly and the electrical plug of FIG. 2.
Figure 4:
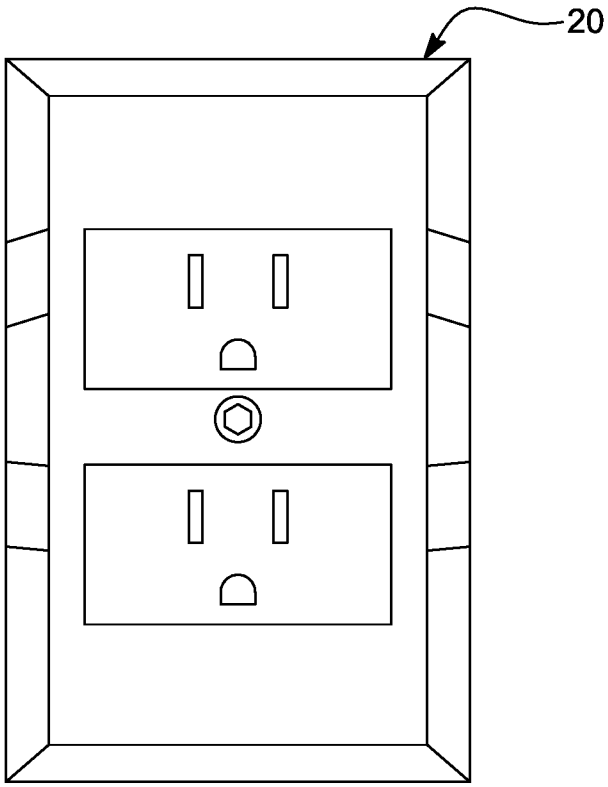
FIG. 4 is a front view of the electrical plug retaining assembly of FIG. 1.
Figure 5:
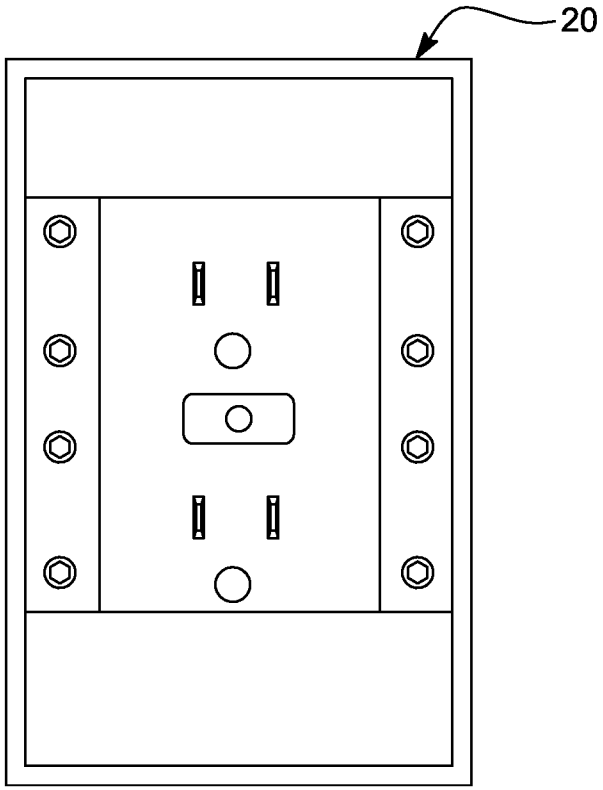
FIG. 5 is a rear view of the electrical plug retaining assembly of FIG. 1.
Figure 15:
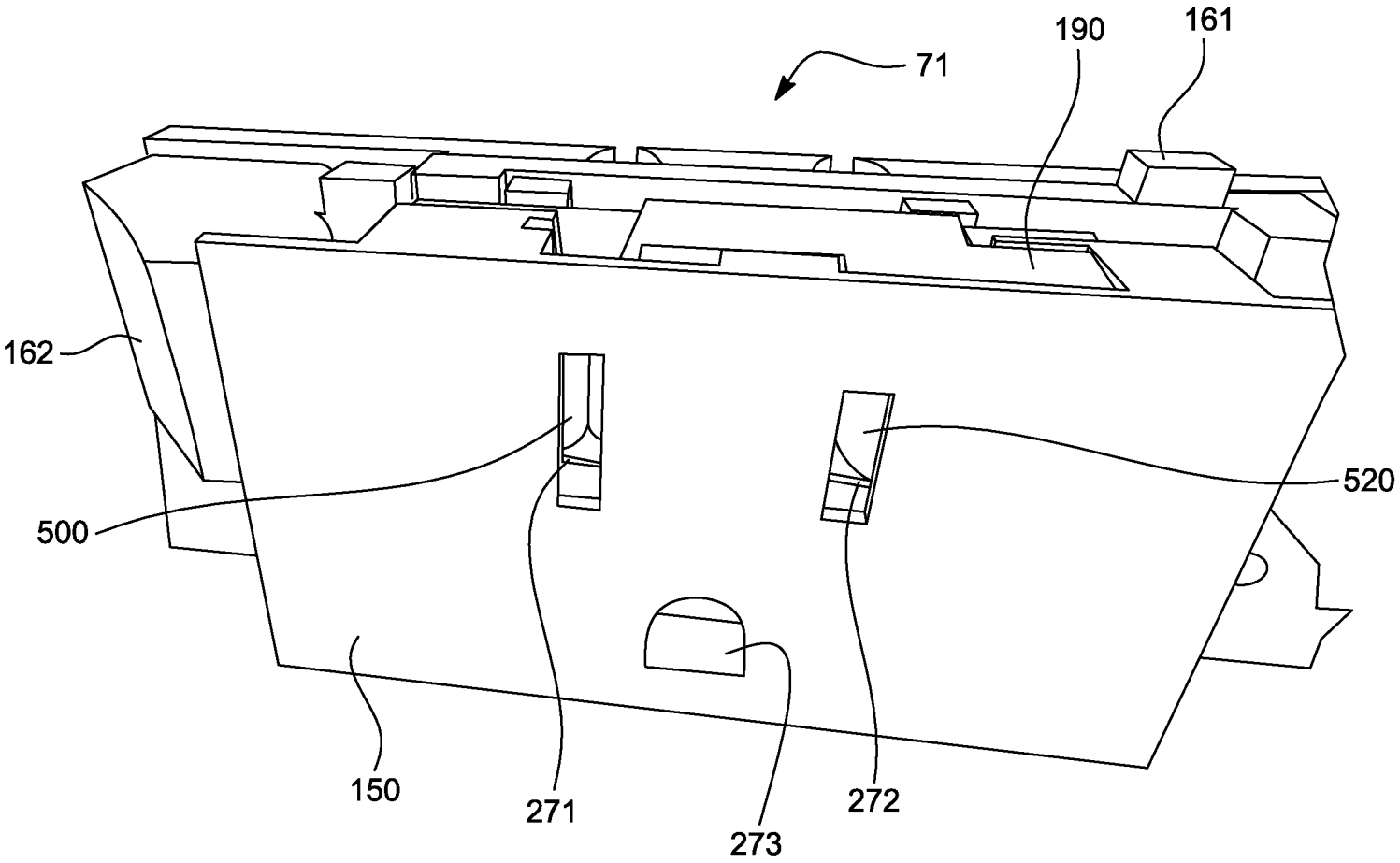
FIG. 15 is another schematic of the first electrical plug socket of FIG. 9 with first and second prong hole apertures not blocked by the prong hole cover member.
Figure 16:
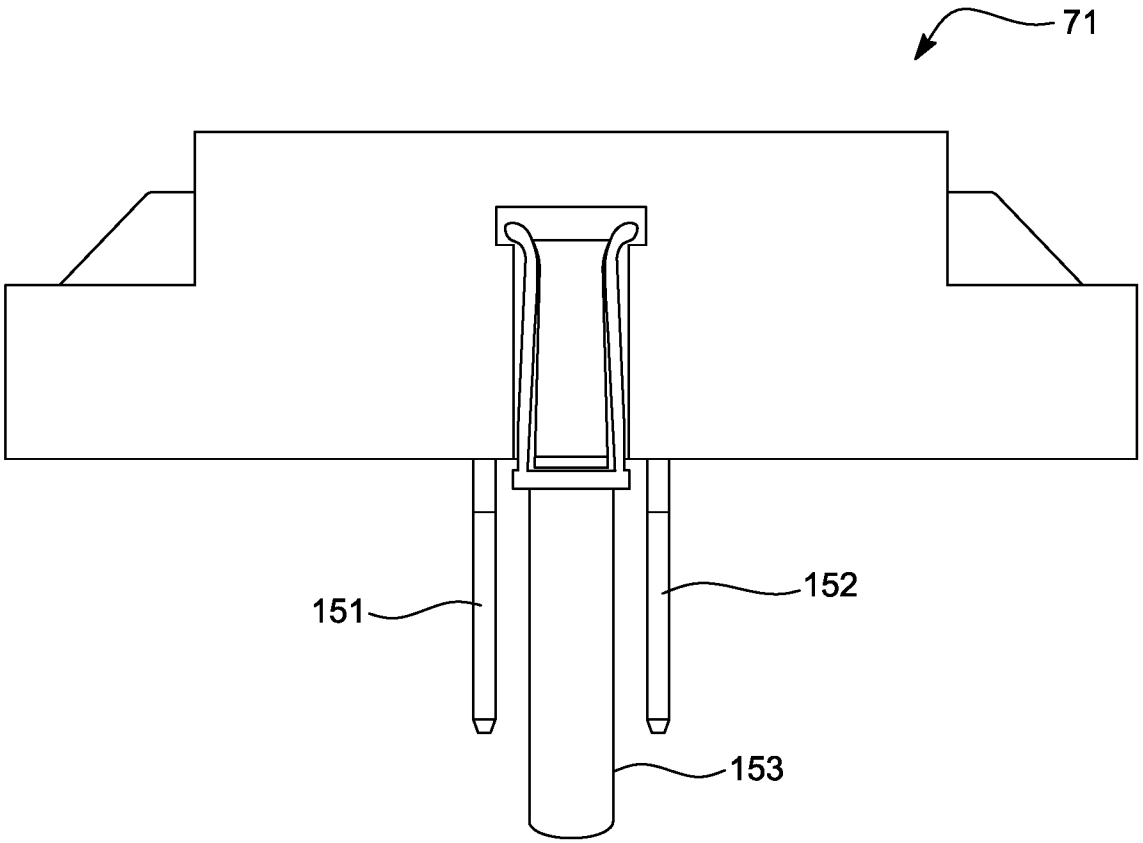
FIG. 16 is a bottom view of the first electrical plug socket of FIG. 9.
Figure 18:
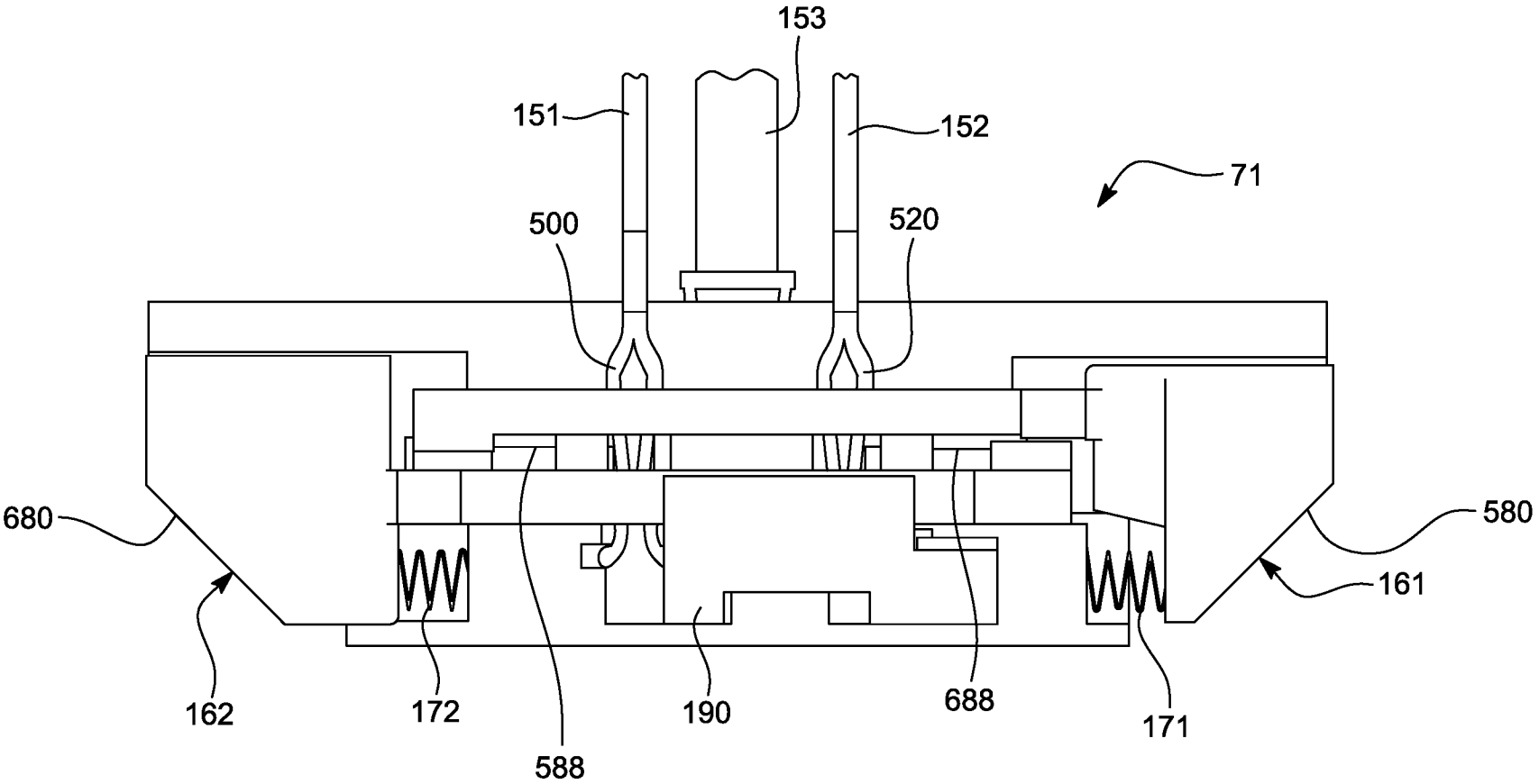
FIG. 18 is a top view of the first electrical plug socket of FIG. 9 with first and second retaining arm assemblies being depressed.

Referring to FIGS. 1, 15 and 18, during operation, when the finger tab portion 580 of the first retaining arm assembly 161 is depressed inwardly toward the housing 150, the pin 588 is moved leftward (in FIG. 18) and out of the holes 511, 512 (shown in FIGS. 24 and 27) of the female terminal portion 500 of the first electrical terminal 151 to allow the first electrical prong 2001 (shown in FIG. 1) of the electrical plug 22 to be received within the female terminal portion 500.

Figure 14:
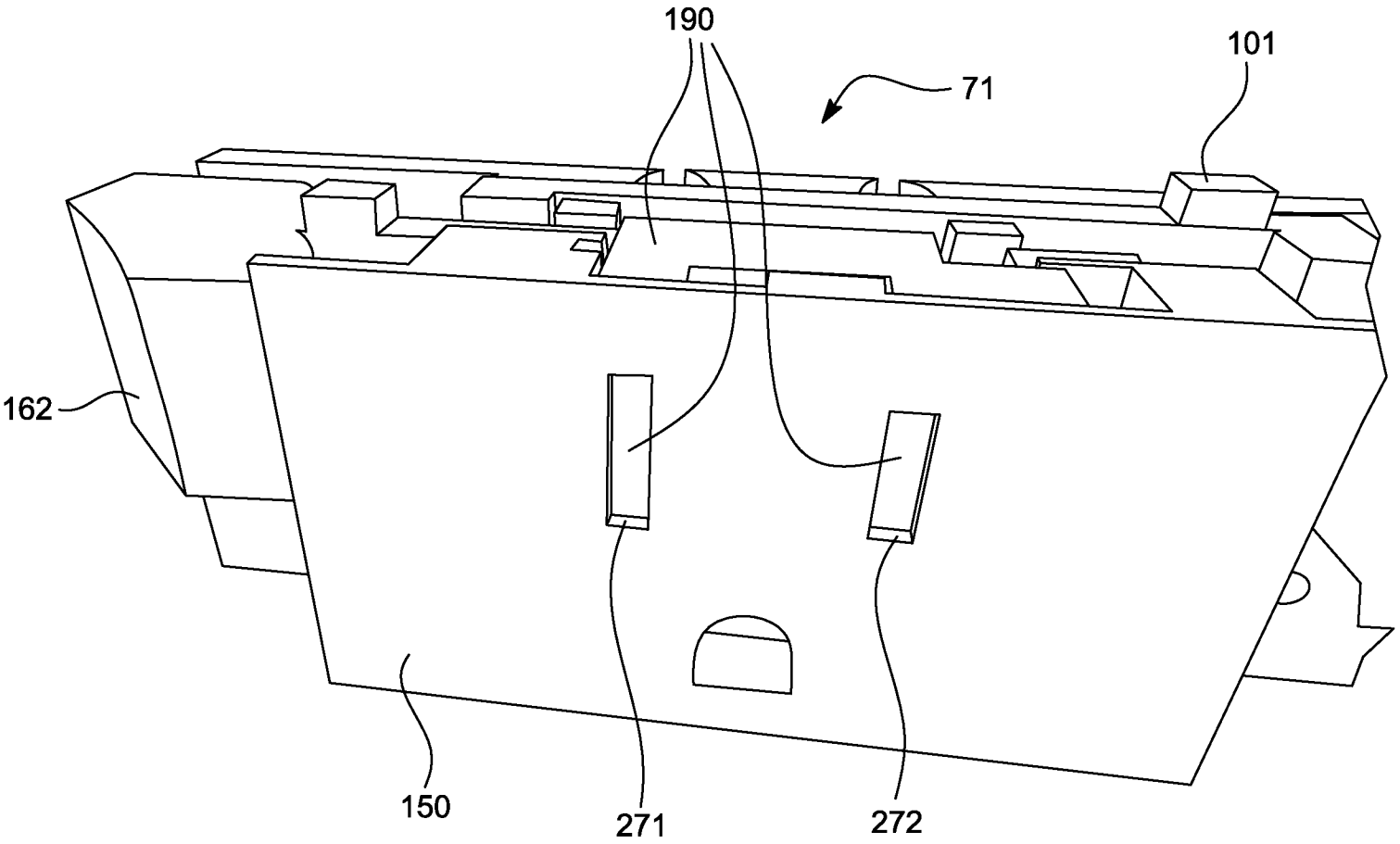
FIG. 14 is another schematic of the first electrical plug socket of FIG. 9 with first and second prong hole apertures blocked by a prong hole cover member.
Figure 17:
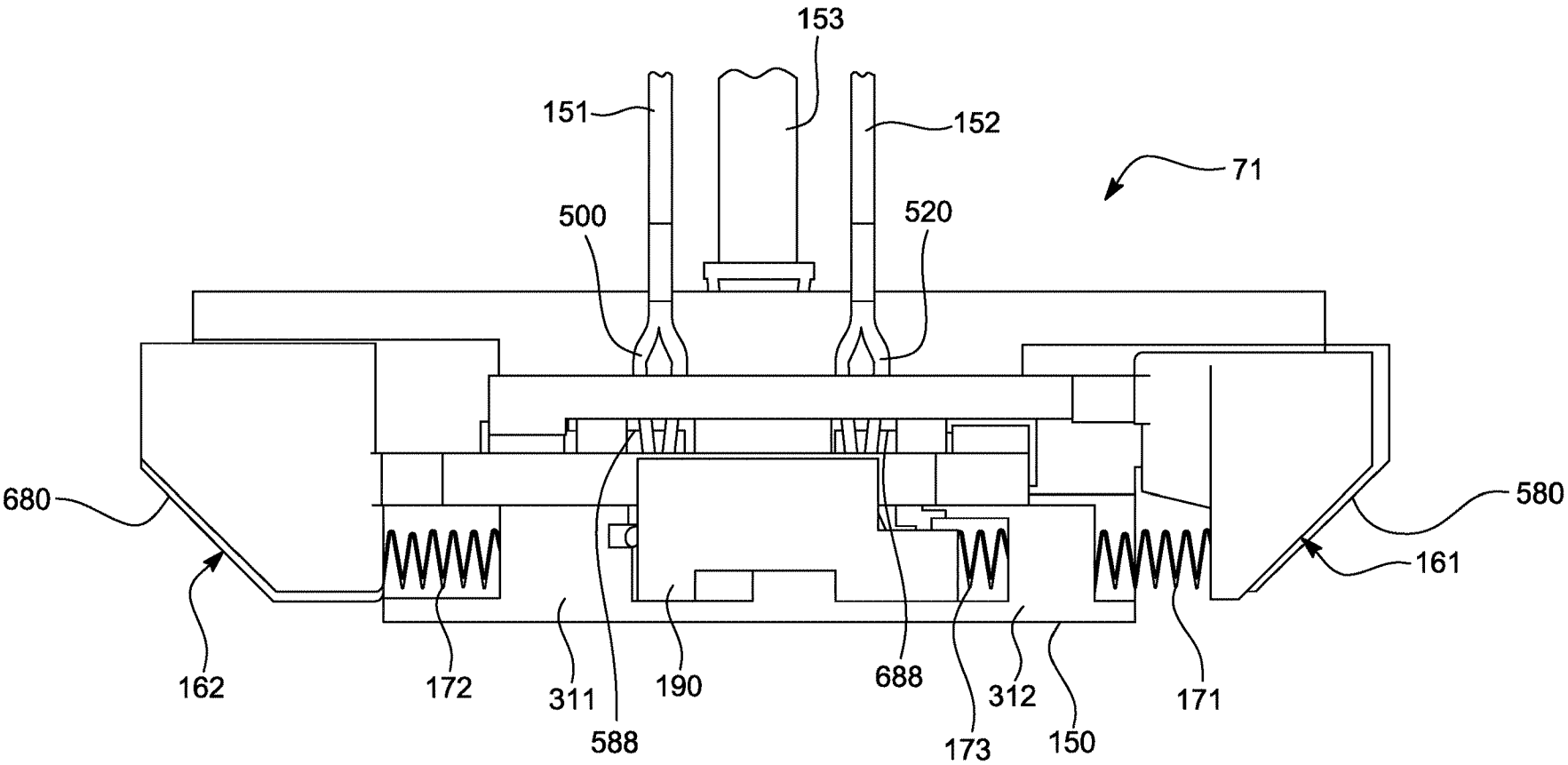
FIG. 17 is a bottom view of the first electrical plug socket of FIG. 9 with first and second retaining arm assemblies not being depressed.

Thereafter, referring to FIGS. 1, 14 and 17, when the finger tab portion 580 of the first retaining arm assembly 161 is not depressed inwardly toward the housing 150, the spring 171 biases the first retaining arm assembly 161 outwardly (rightward in FIG. 17) such that the pin 588 is moved rightward (in FIG. 17) and through the holes 511, 512 (shown in FIGS. 24 and 27) of the female terminal portion 500 of the first electrical terminal 151 and the hole 2011 (shown in FIG. 1) in the first electrical prong 2001 to secure the first electrical prong 2001 in the female terminal portion 500 of the first electrical terminal 151.

Referring to FIGS. 17 and 33-35, the second retaining arm assembly 162 is slidably disposed on the housing 150 and extends over the female terminal portions 500, 520. The second retaining arm assembly 162 has a finger tab portion 680, a horizontal shaft portion 682, a tab portion 684, a pin holding portion 686, and a pin 688. The horizontal shaft portion 682 is coupled to and between the finger tab portion 680 and the pin holding portion 686. The horizontal shaft portion 682 includes a slot 690 formed therein for receiving a top plate portion 720 (shown in FIG. 36) of the prong hole cover member 190 therein. The pin holding portion 686 extends downwardly from the horizontal shaft portion 682. The pin 688 is coupled to the pin holding portion 686 and extends toward the tab portion 680. The tab portion 684 is coupled to and extends upwardly from the horizontal shaft portion 682 and is disposed proximate to the finger tab portion 680. The finger tab portion 680 includes an aperture 700 (shown in FIG. 34) extending therein for receiving the spring 172 (shown in FIG. 17) therein. The horizontal shaft portion 682 is slidably disposed in the longitudinal groove 402 (shown in FIG. 20) on the central support portion 252. Further, the spring 172 is disposed in the aperture 350 (shown in FIG. 22) of the housing 150 and in the aperture 700 (shown in FIG. 34) of the finger tab portion 680 and biases the second retaining arm assembly 162 outwardly (leftward in FIG. 17).

Referring to FIGS. 1, 15 and 17, during operation, when the finger tab portion 680 of the second retaining arm assembly 162 is depressed inwardly toward the housing 150, the pin 688 is moved rightward (in FIG. 18) and out of the holes 531, 532 (shown in FIG. 28) of the female terminal portion 520 of the second electrical terminal 152 to allow the second electrical prong 2002 (shown in FIG. 1) of the electrical plug 22 to be received within the female terminal portion 520.

Thereafter, referring to FIGS. 1, 14 and 17, when the finger tab portion 680 of the second retaining arm assembly 162 is not depressed inwardly toward the housing 150, the spring 172 biases the second retaining arm assembly 162 outwardly (leftward in FIG. 18) such that the pin 688 is moved leftward (in FIG. 17) and through the holes 531, 532 (shown in FIG. 28) of the female terminal portion 520 of the second electrical terminal 152 and the hole 2012 (shown in FIG. 1) in the second electrical prong 2002 to secure the second electrical prong 2002 in the female terminal portion 520 of the second electrical terminal 152.

Figure 26:
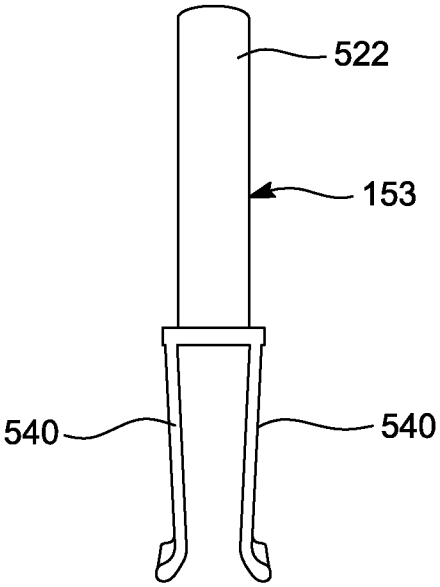
FIG. 26 is a schematic of a third electrical terminal utilized in the first electrical plug socket of FIG. 9.
Figure 24:
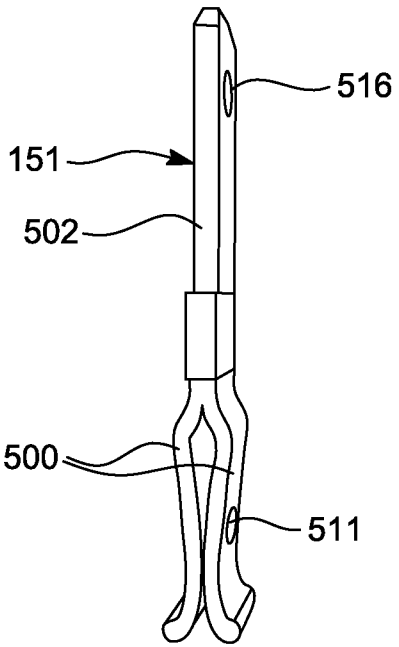
FIG. 24 is a schematic of a first electrical terminal utilized in the first electrical plug socket of FIG. 9.
Figure 28:
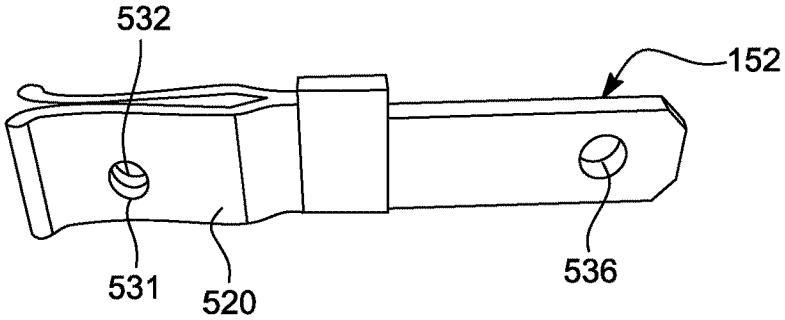
FIG. 28 is another schematic of the second electrical terminal of FIG. 25.
Figure 27:
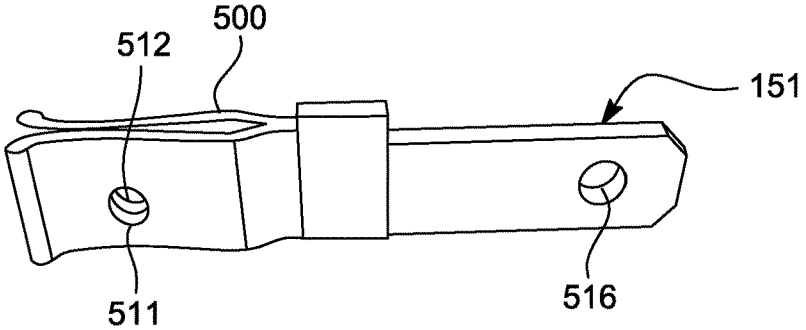
FIG. 27 is another schematic of the first electrical terminal of FIG. 24.
Figure 29:
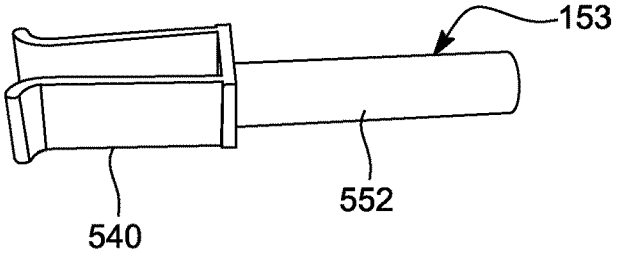
FIG. 29 is another schematic of the third electrical terminal of FIG. 26.
Figure 30:
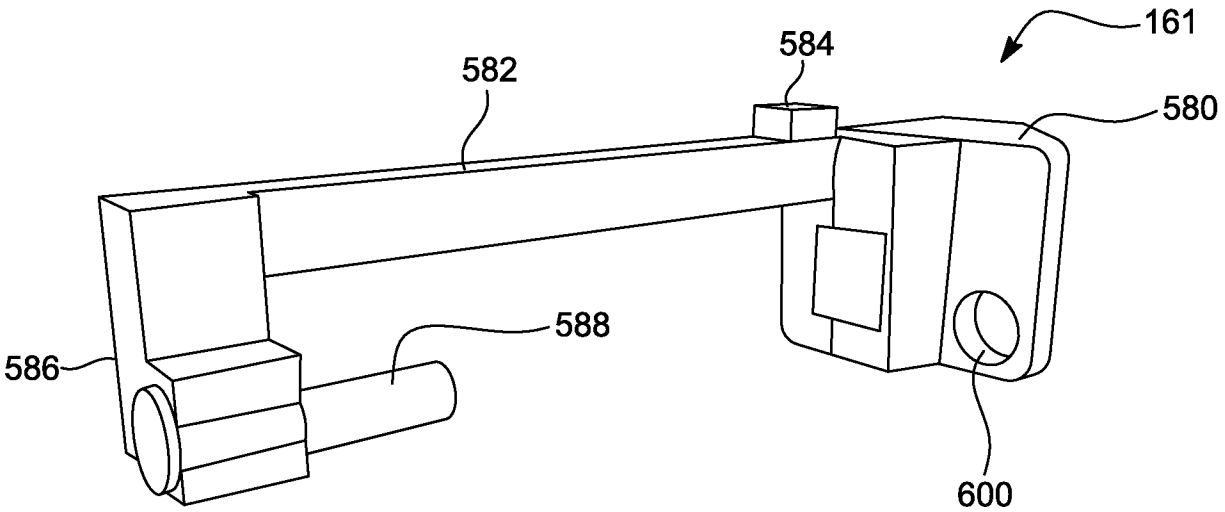
FIG. 30 is a schematic of a first retaining arm assembly utilized in the first electrical plug socket of FIG. 9.
Figure 31:
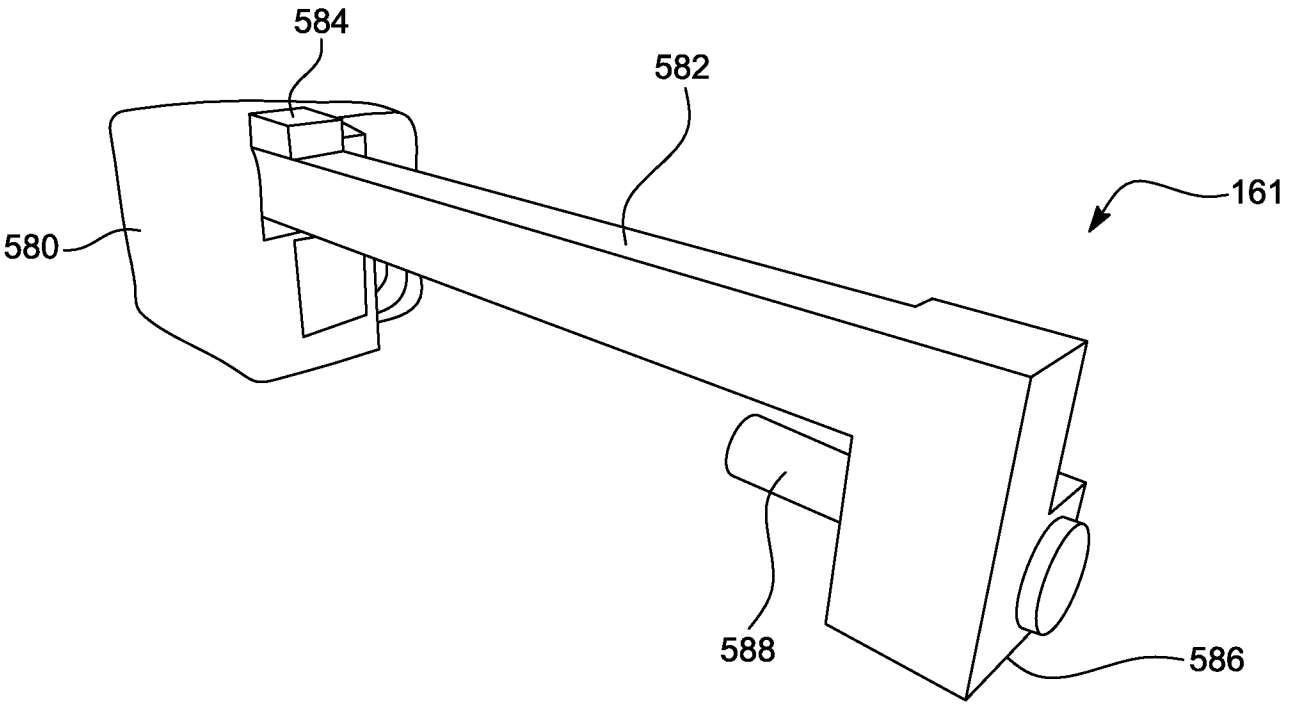
FIG. 31 is another schematic of the first retaining arm assembly of FIG. 30.
Figure 32:
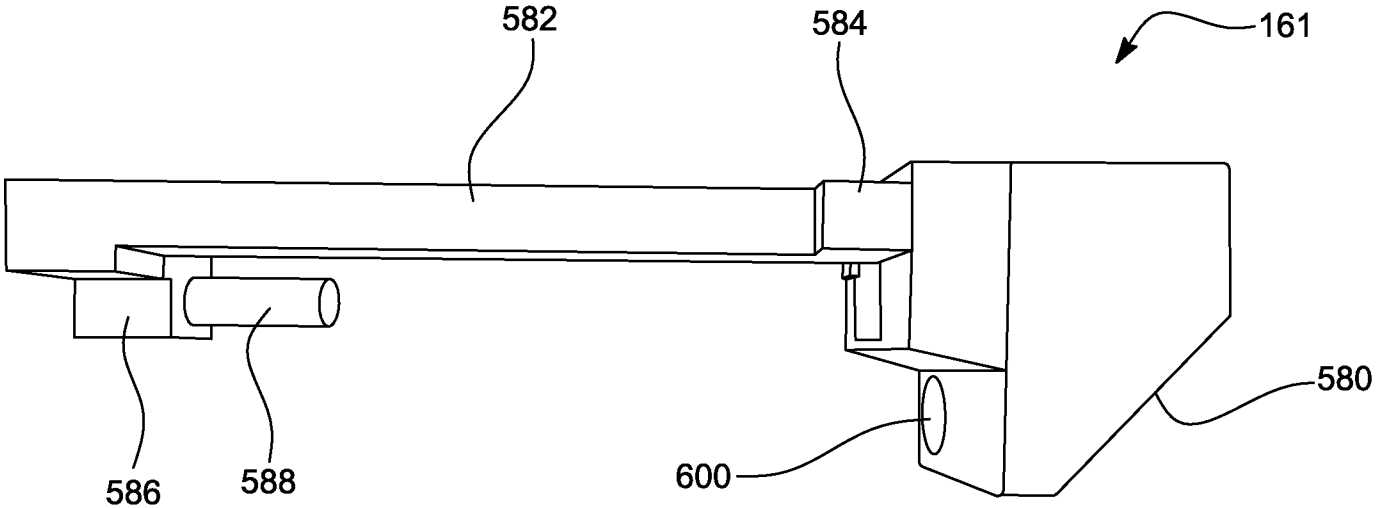
FIG. 32 is another schematic of the first retaining arm assembly of FIG. 30.
Figure 33:
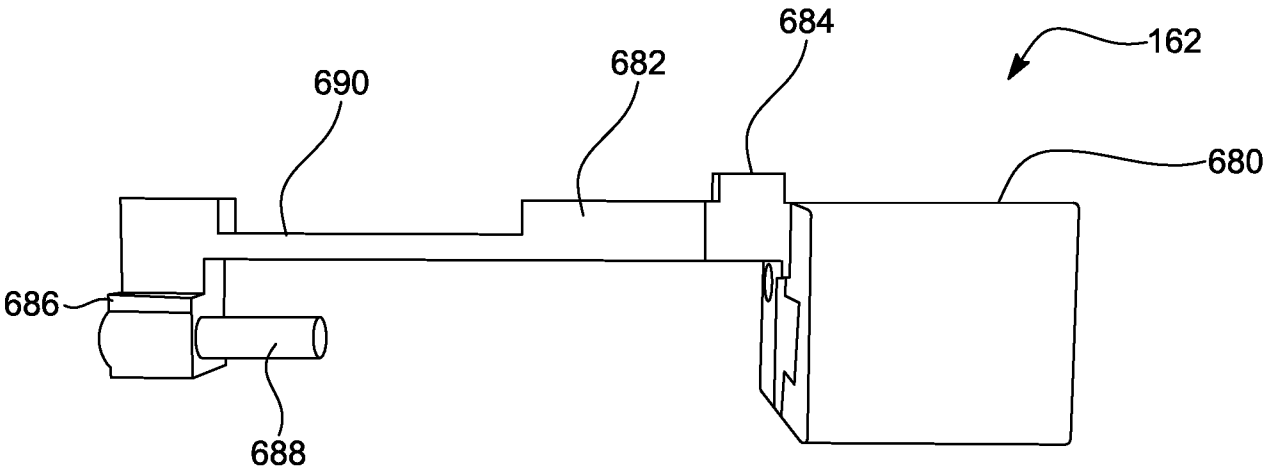
FIG. 33 is a schematic of a second retaining arm assembly utilized in the first electrical plug socket of FIG. 9.
Figure 34:
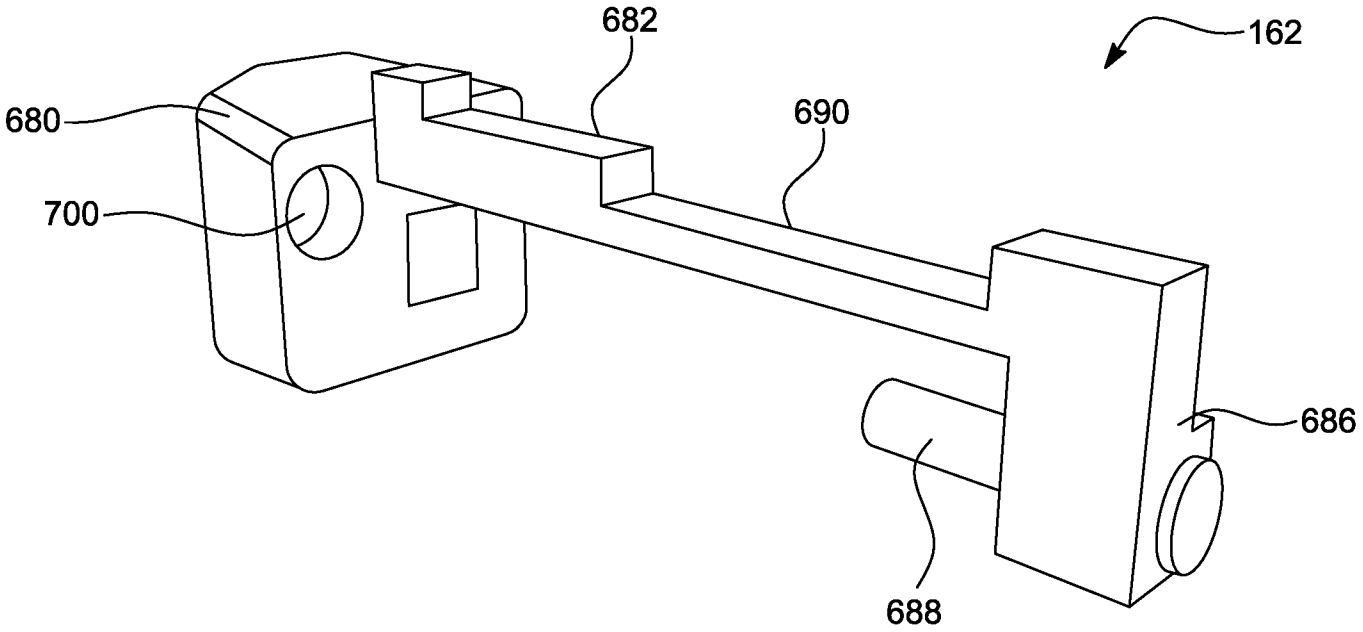
FIG. 34 is another schematic of the second retaining arm assembly of FIG. 33.
Figure 35:
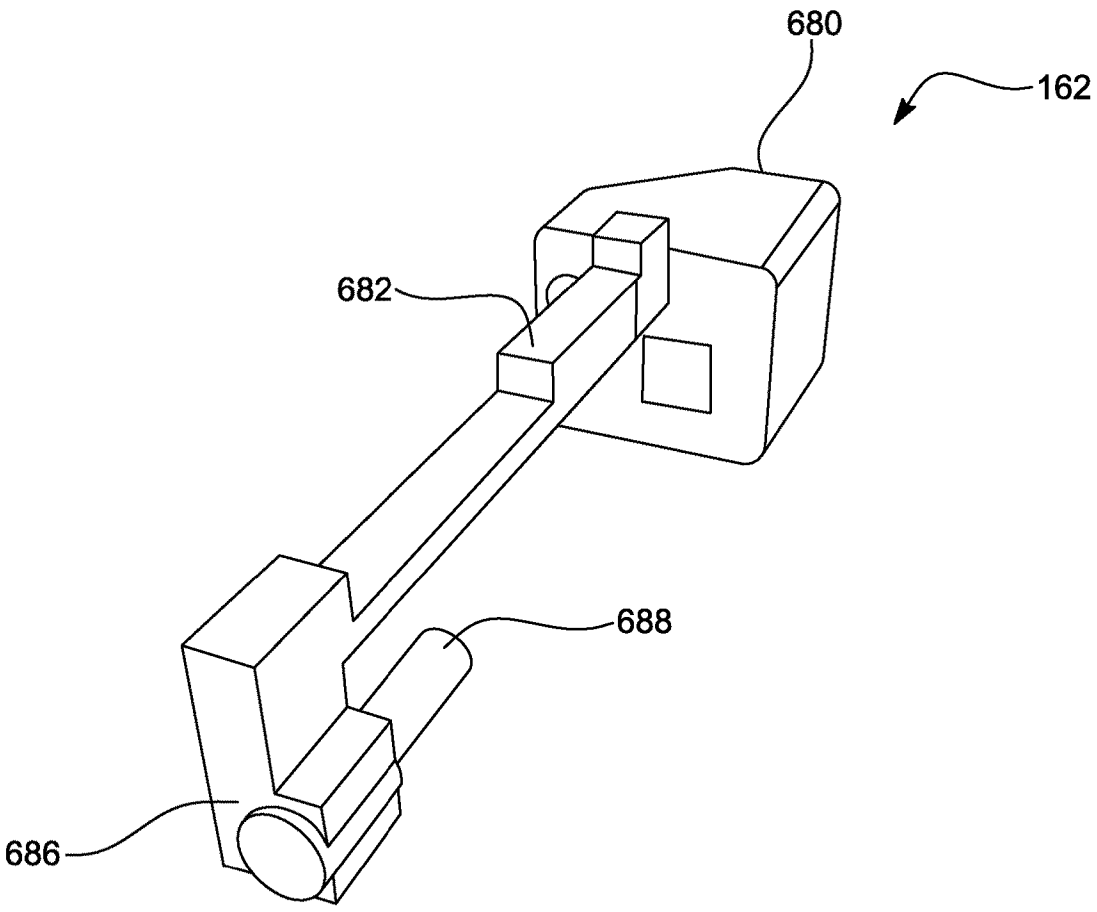
FIG. 35 is another schematic of the second retaining arm assembly of FIG. 33.

Referring to FIGS. 1, 19 and 26, the third electrical prong 2003 of the electrical plug 22 is received through the prong aperture 273 and into the female terminal portion 540 of the third electrical terminal 153.

Referring to FIGS. 17 and 36-39, the prong hole cover member 190 is slidably coupled to the housing 150.

Referring to FIGS. 14 and 17, when the first and second retaining arm assemblies 161, 162 are not depressed, the prong hole cover member 190 has a first operational position in which the prong hole cover member 190 covers a rear side of the prong apertures 271, 272 to prevent the first and second electrical prongs 2001, 2002 (shown in FIG. 1) from being inserted into the prong apertures 271, 272, respectively. Referring to FIGS. 15 and 18, when the first and second retaining arm assemblies 161, 162 are depressed, the prong hole cover member 190 has a second operational position in which the prong hole cover member 190 does not cover a rear side of the prong apertures 271, 272 to allow the first and second electrical prongs 2001, 2002 (shown in FIG. 1) to be inserted into the prong apertures 271, 272, respectively.

The prong hole cover member 190 includes a top plate portion 720, a vertical side wall 722, a vertical side wall 724, and a vertical end wall 726. The vertical side walls 722, 724 are coupled to and extend downwardly from the top plate portion 720. The vertical end wall 726 is coupled to the vertical side wall 724 and the top plate portion 720. The top plate portion 720 is disposed in the slot 690 (shown in FIG. 34) of the horizontal shaft portion 682. The vertical side wall 722 is disposed within the cavity 421 (shown in FIG. 20). Further, the vertical side wall 724 is disposed within the cavity 422 (shown in FIG. 20). The spring 171 contacts and is disposed between the second front vertical portion 312 of the housing 150 and the vertical end wall 726. In an exemplary embodiment, the prong hole cover member 190 is constructed of plastic.

Figure 36:
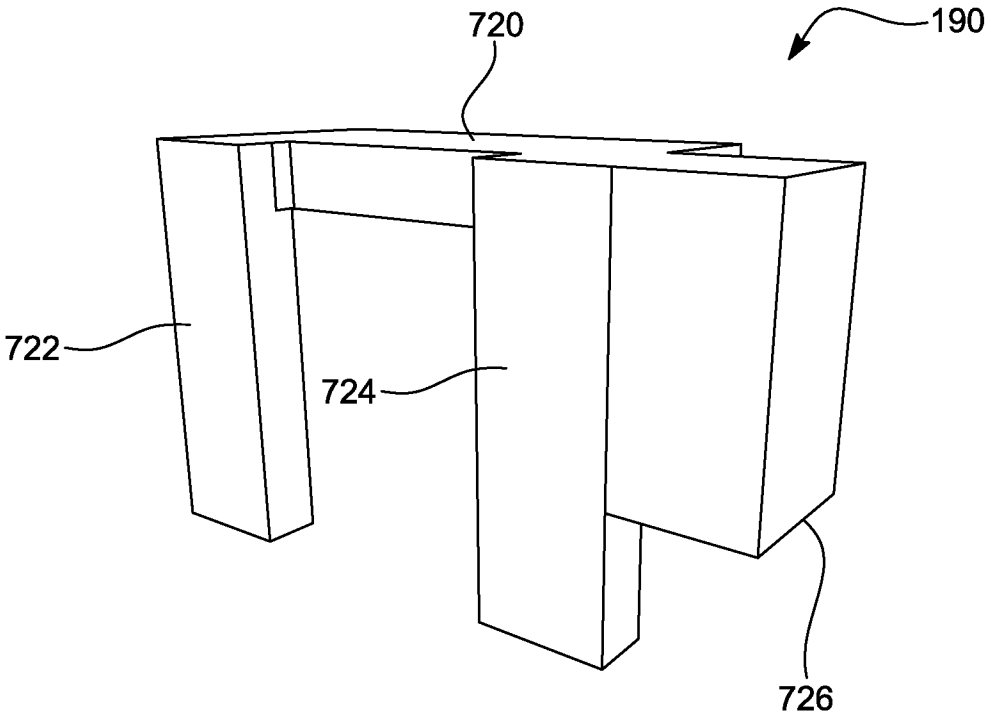
FIG. 36 is a schematic of a prong hole cover member utilized in the first electrical plug socket of FIG. 9.
Figure 37:
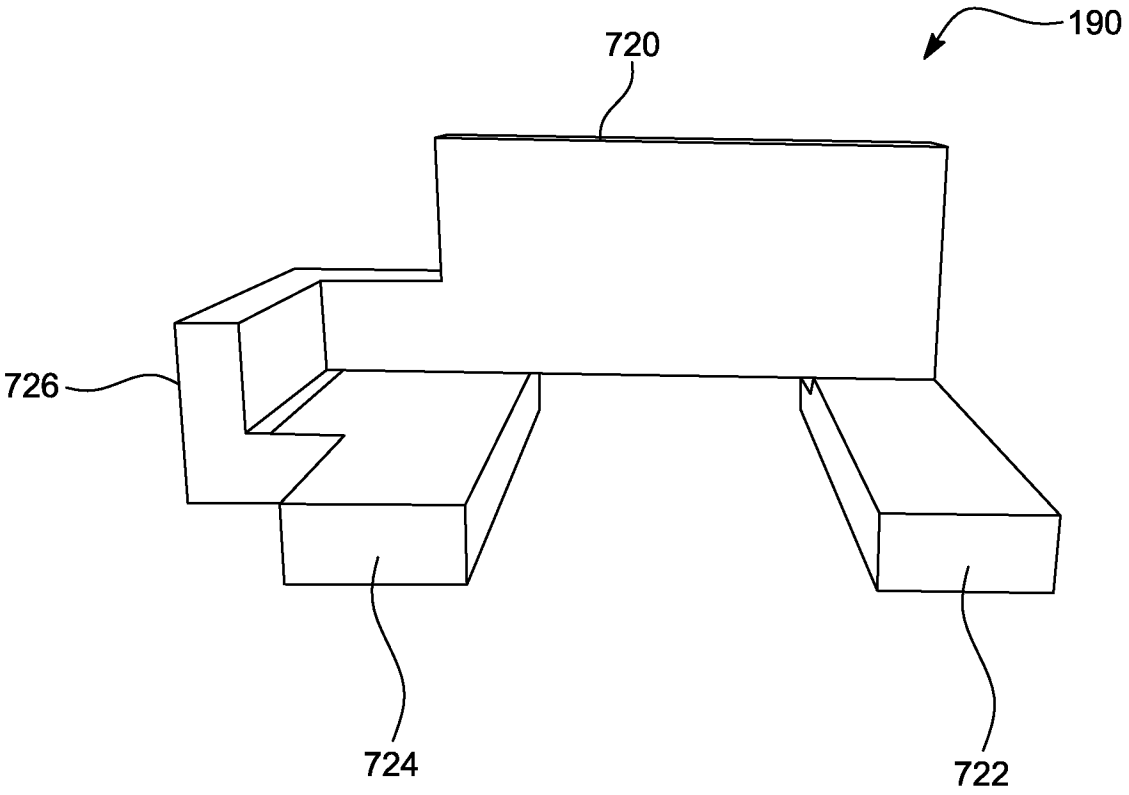
FIG. 37 is another schematic of the prong hole cover member of FIG. 36.
Figure 38:
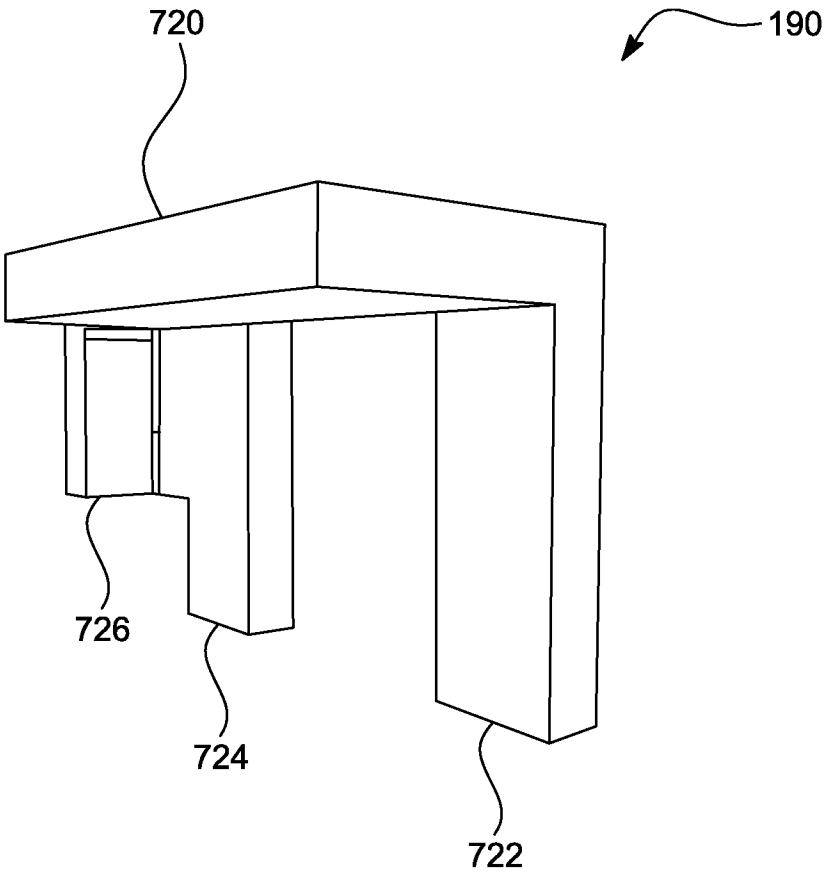
FIG. 38 is another schematic of the prong hole cover member of FIG. 36.
Figure 39:
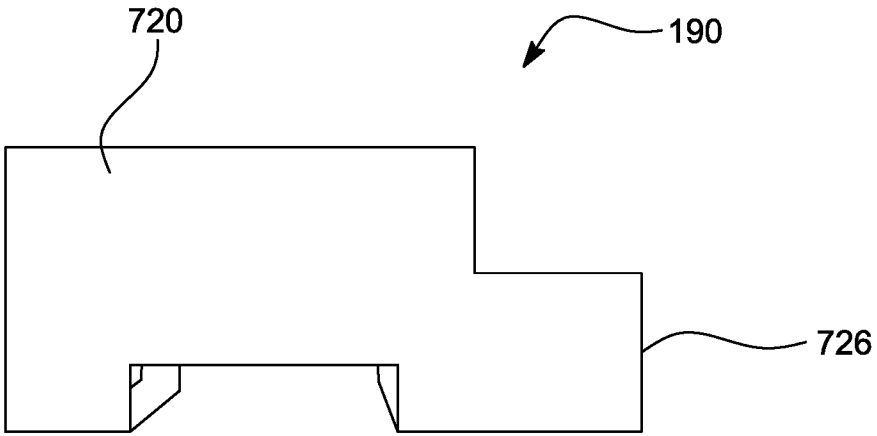
FIG. 39 is another schematic of the prong hole cover member of FIG. 36.

Referring to FIGS. 14, 17 and 36, when the first and second retaining arm assemblies 161, 162 are not depressed inwardly toward the housing 150, the spring 171 biases the prong hole cover member 190 leftward (in FIG. 17) such that the vertical side walls 722, 724 cover the rear ends of the prong apertures 271, 272, respectively to prevent the first and second electrical prongs 2001, 2002 (shown in FIG. 1) from being inserted into the prong apertures 271, 272, respectively.

Alternately, referring to FIGS. 15, 18 and 36, when the first and second retaining arm assemblies 161, 162 are depressed inwardly toward the housing 150, the second retaining arm assembly 162 moves the prong hole cover member 190 rightward (in FIG. 15) such that the vertical side walls 722, 724 do not cover the rear ends of the prong apertures 271, 272, respectively to allow the first and second electrical prongs 2001, 2002 (shown in FIG. 1) to be inserted into the prong apertures 271, 272, respectively.

Figure 40:
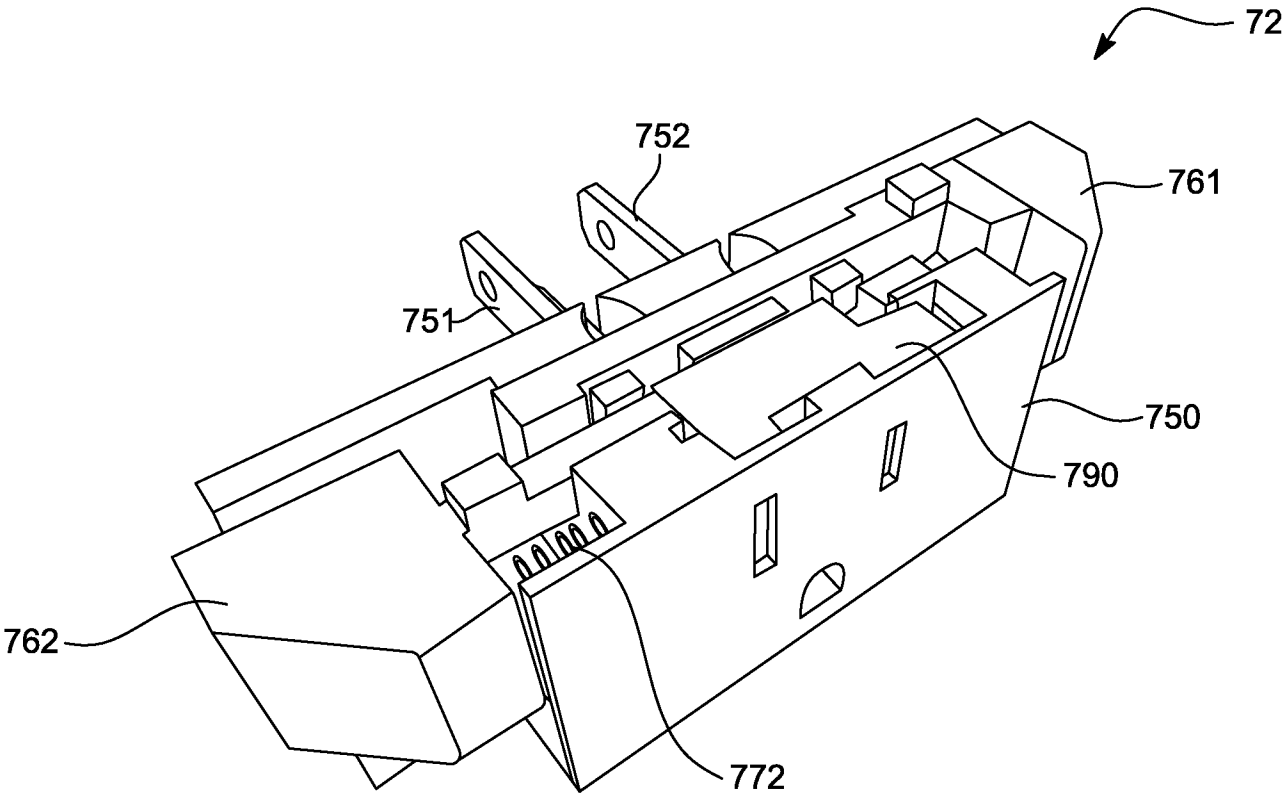
FIG. 40 is a schematic of a second electrical plug socket utilized in the electrical plug retaining assembly of FIG. 1.
Figure 41:
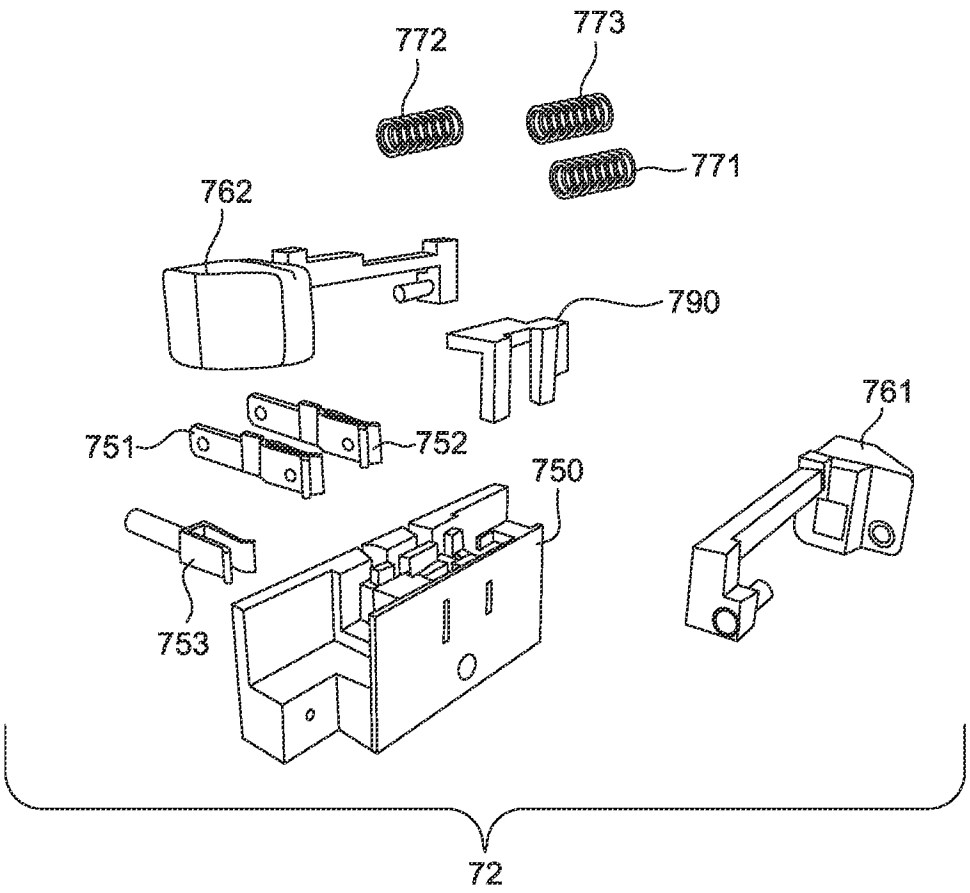
FIG. 41 is an exploded view of the second electrical plug socket of FIG. 40.
Figure 42:
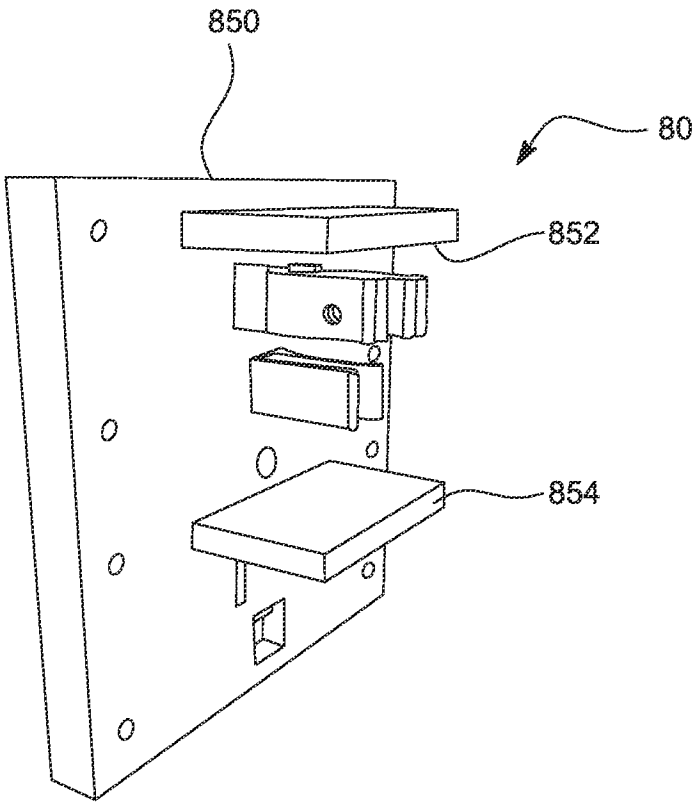
FIG. 42 is a schematic of a rear support plate assembly utilized in the electrical plug retaining assembly of FIG. 1.
Figure 43:
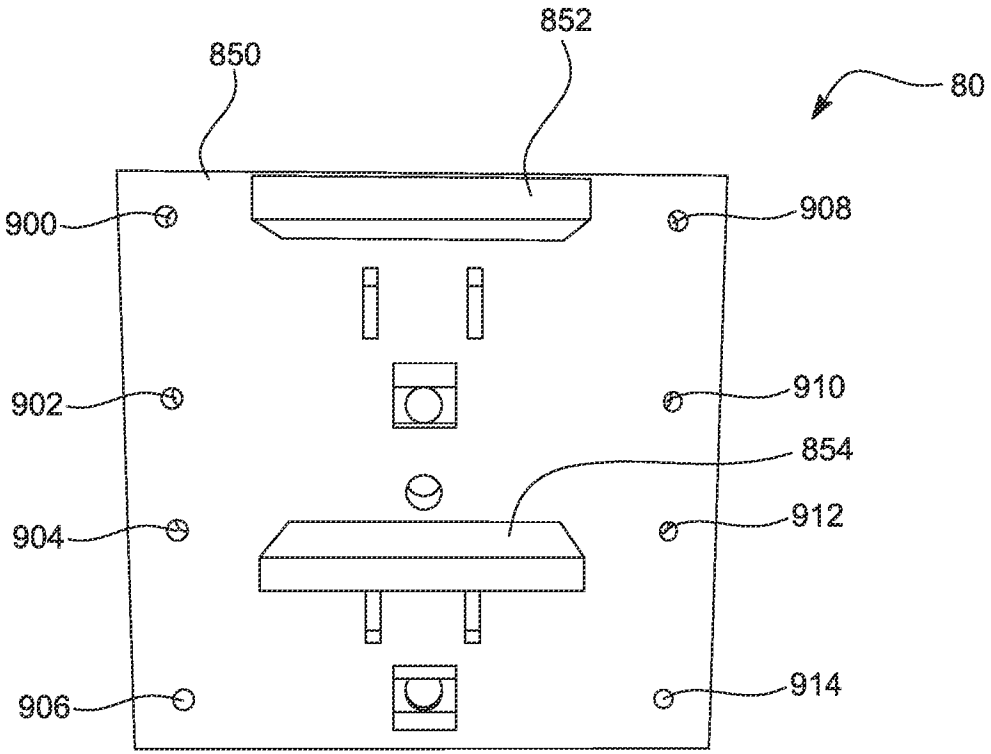
FIG. 43 is a schematic of the rear support plate assembly of FIG. 42.

Referring to FIGS. 1 and 40-41, the electrical plug socket 72 is coupled to the rear support plate assembly 80. The electrical plug socket 72 receives first and second electrical prongs of another electrical plug (not shown) therein when first and second retaining arm assemblies 761, 762 in the electrical plug socket 72 are depressed. The electrical plug socket 72 secures the first and second electrical prongs of the electrical plug therein when first and second springs 771, 772 in the electrical plug socket 72 bias the first and second retaining arm assemblies 761, 762, respectively, thereof in first and second directions, respectively, when the first and second retaining arm assemblies 761, 762 in the electrical plug socket 72 are not depressed. The electrical plug socket 72 has an identical structure as the electrical plug 71 and includes a housing 750, a first electrical terminal 751, a second electrical terminal 752, a third electrical terminal 753, a first retaining arm assembly 761, a second retaining arm assembly 762, a first spring 771, a second spring 772, a third spring 773, and a prong hole cover member 790.

Referring to FIGS. 7 and 42-46, the rear support plate assembly 80 is provided to hold the remaining components of the electrical plug retaining assembly 20 thereon. The rear support plate assembly 80 includes a support plate 850 and horizontal walls 852, 854 that extend outwardly from the support plate 850.

The support plate 850 includes apertures 900, 902, 904, 906, 908, 910, 912, 914, an attachment bolt aperture 920, prong apertures 951, 952, 953, and prong apertures 971, 972, 973.

Figure 44:
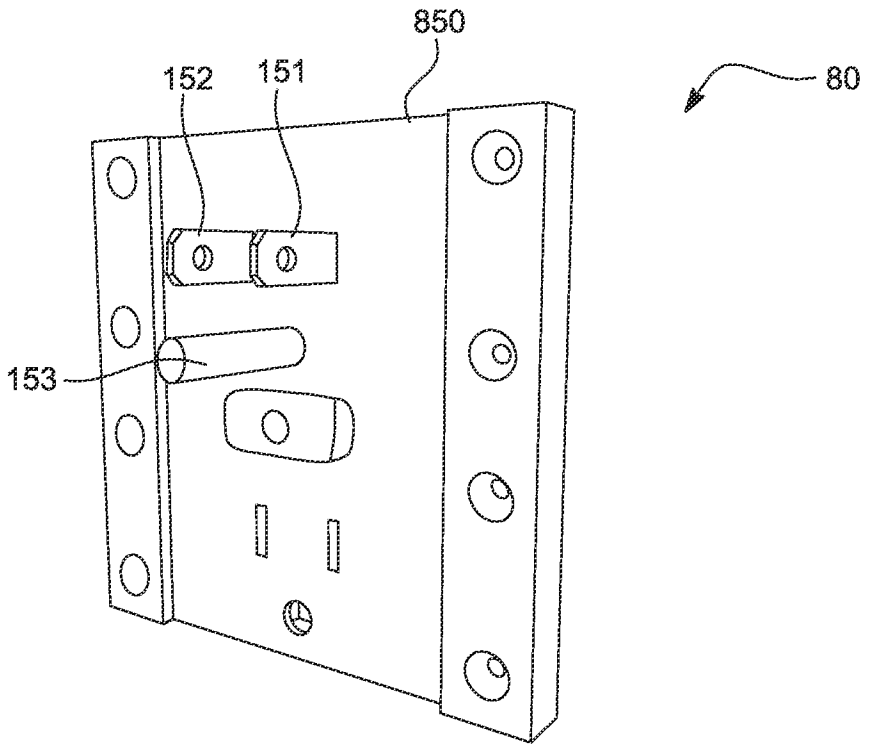
FIG. 44 is another schematic of the rear support plate assembly of FIG. 42.
Figure 45:
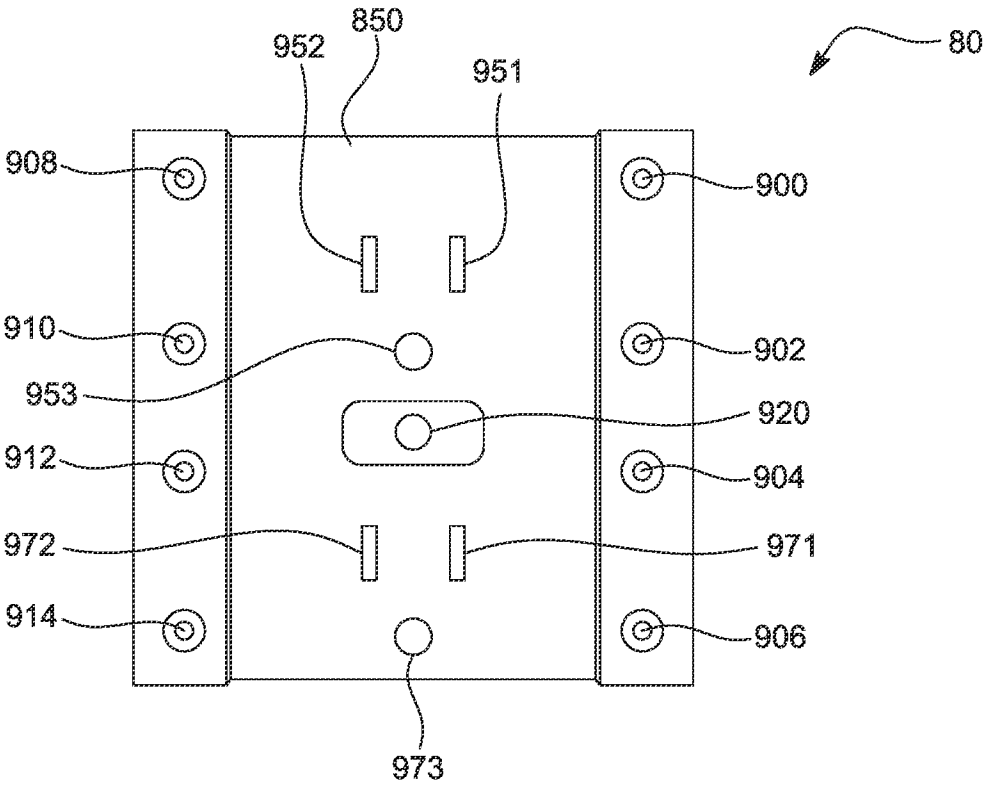
FIG. 45 is a front view of the rear support assembly of FIG. 42.
Figure 46:
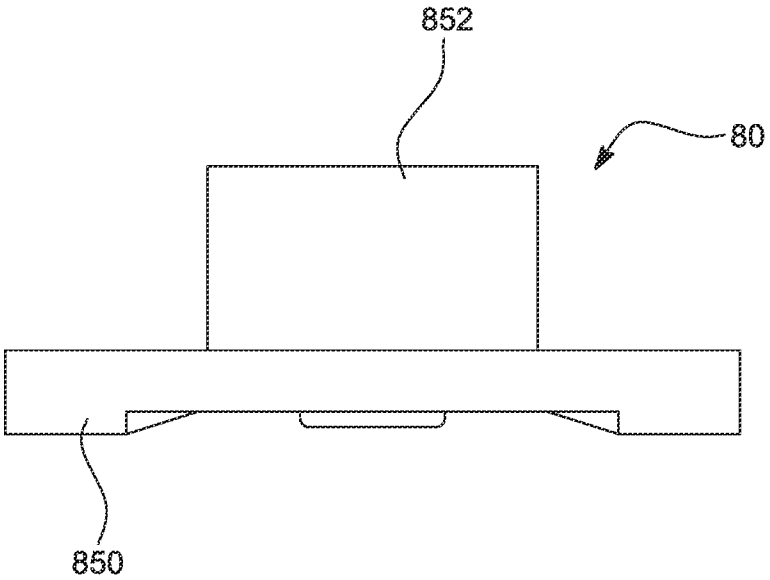
FIG. 46 is a top view of the rear support assembly of FIG. 42.

Referring to FIGS. 7, 44 and 45, the electrical plug socket 71 is disposed between the horizontal walls 852, 854 such that the first, second, third electrical terminals 151, 152, 153 extend through the prong apertures 951, 952, 953, respectively.

Referring to FIGS. 7 and 45, the electrical plug socket 72 is disposed below the horizontal wall 854 such that the first, second, third electrical terminals 751, 752, 753 extend through the prong apertures 971, 972, 953, respectively.

Referring to FIGS. 7, 45, 50 and 51, the bolt 100 extends through the aperture 900 in the rear support plate assembly 80 and into the aperture 1900 of the front cover plate 82 to couple the rear support plate assembly 80 to the front cover plate 82, with the electrical plug sockets 71, 72 secured between the rear support plate assembly 80 and the front cover plate 82.

The bolt 102 extends through the aperture 902 in the rear support plate assembly 80 and into the aperture 1902 of the front cover plate 82 to couple the rear support plate assembly 80 to the front cover plate 82, with the electrical plug sockets 71, 72 secured between the rear support plate assembly 80 and the front cover plate 82.

The bolt 104 extends through the aperture 904 in the rear support plate assembly 80 and into the aperture 1904 of the front cover plate 82 to couple the rear support plate assembly 80 to the front cover plate 82, with the electrical plug sockets 71, 72 secured between the rear support plate assembly 80 and the front cover plate 82.

The bolt 106 extends through the aperture 906 in the rear support plate assembly 80 and into the aperture 1906 of the front cover plate 82 to couple the rear support plate assembly 80 to the front cover plate 82, with the electrical plug sockets 71, 72 secured between the rear support plate assembly 80 and the front cover plate 82.

The bolt 108 extends through the aperture 908 in the rear support plate assembly 80 and into the aperture 1908 of the front cover plate 82 to couple the rear support plate assembly 80 to the front cover plate 82, with the electrical plug sockets 71, 72 secured between the rear support plate assembly 80 and the front cover plate 82.

The bolt 110 extends through the aperture 910 in the rear support plate assembly 80 and into the aperture 1910 of the front cover plate 82 to couple the rear support plate assembly 80 to the front cover plate 82, with the electrical plug sockets 71, 72 secured between the rear support plate assembly 80 and the front cover plate 82.

The bolt 112 extends through the aperture 912 in the rear support plate assembly 80 and into the aperture 1912 of the front cover plate 82 to couple the rear support plate assembly 80 to the front cover plate 82, with the electrical plug sockets 71, 72 secured between the rear support plate assembly 80 and the front cover plate 82.

The bolt 114 extends through the aperture 914 in the rear support plate assembly 80 and into the aperture 1914 of the front cover plate 82 to couple the rear support plate assembly 80 to the front cover plate 82, with the electrical plug sockets 71, 72 secured between the rear support plate assembly 80 and the front cover plate 82.

Referring to FIGS. 7 and 47-51, the front cover plate 82 is provided to enclose portions of the electrical plug sockets 71, 72 and to be coupled to the rear support plate assembly 80. The front cover plate 82 is further coupled to the wall outlet 24 (shown in FIG. 6) utilizing a bolt 120. The front cover plate 82 includes socket receiving apertures 1071, 1072, an attachment bolt aperture 1020, retaining arm apertures 1161, 1162, 1761, 1762, and apertures 1900, 1902, 1904, 1906, 1908, 1910, 1912, 1914. The socket receiving apertures 1071, 1072 are aligned with the electrical plug sockets 71, 72, respectively to allow access to the electrical plug sockets 71, 72, respectively. The retaining arm apertures 1161, 1162 (shown in FIG. 47) are aligned with the finger tab portions 580, 680, respectively, of the first and second retaining arm assemblies 161, 162, respectively, to allow access to the finger tab portions 580, 680, respectively. The retaining arm apertures 1761, 1762 (shown in FIG. 47) are aligned with the first and second finger tab portions, respectively, of the first and second retaining arm assemblies 761, 762, respectively, to allow access to the first and second finger tab portions of the first and second retaining arm assembly 761, 762.

Figure 6:
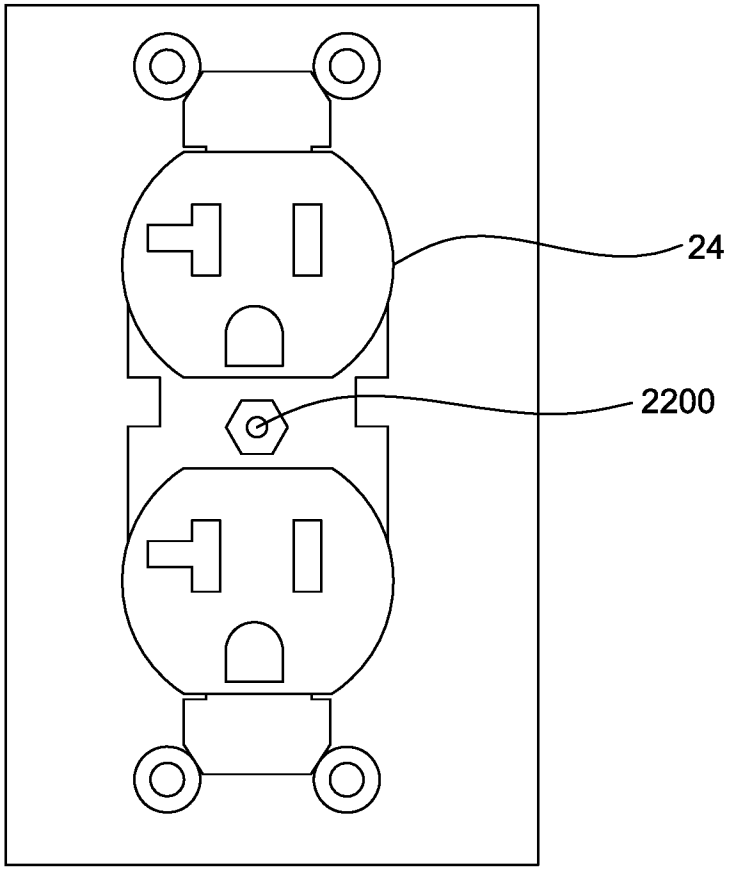
FIG. 6 is a schematic of an exemplary wall outlet.
Figure 47:
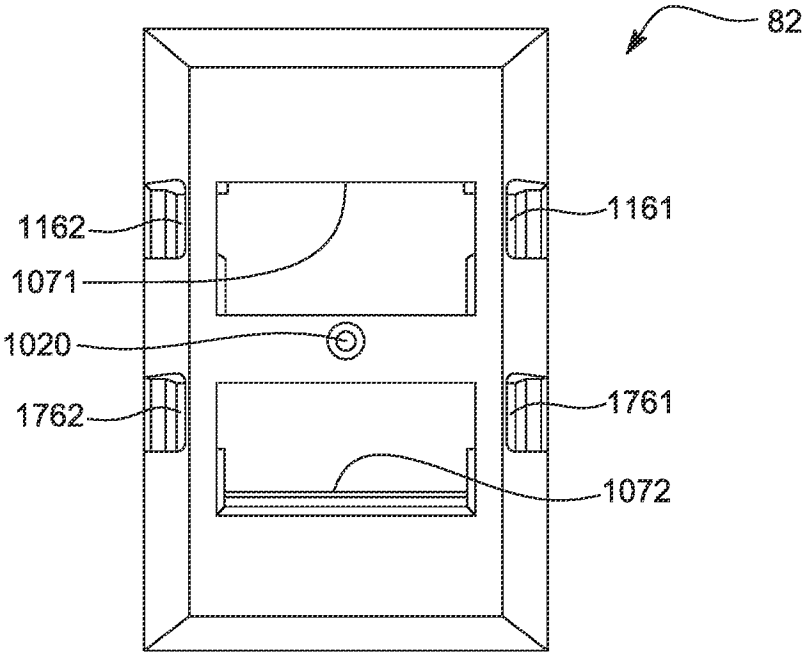
FIG. 47 is a schematic of a front cover plate utilized in the electrical plug retaining assembly of FIG. 1.
Figure 48:
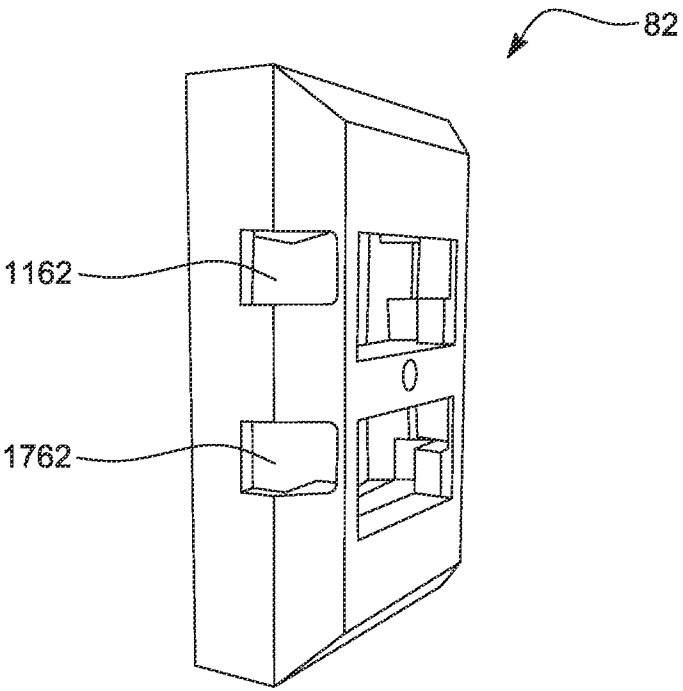
FIG. 48 is another schematic of the front cover plate of FIG. 47.
Figure 49:
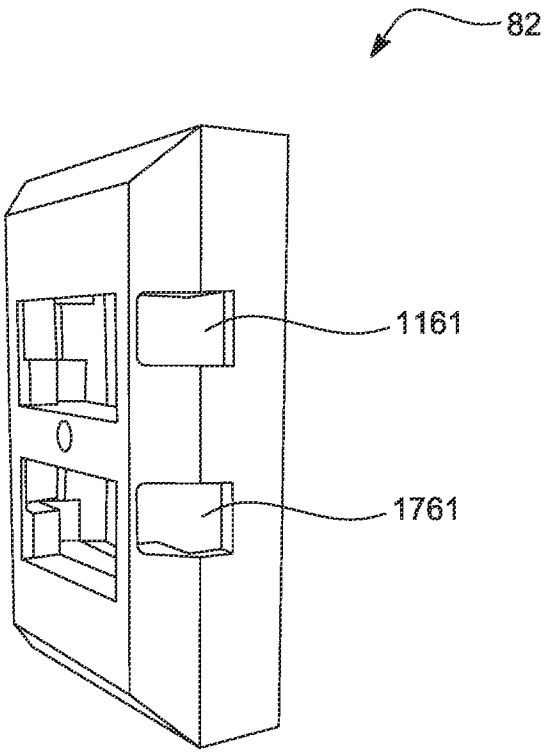
FIG. 49 is another schematic of the front cover plate of FIG. 47.
Figure 50:
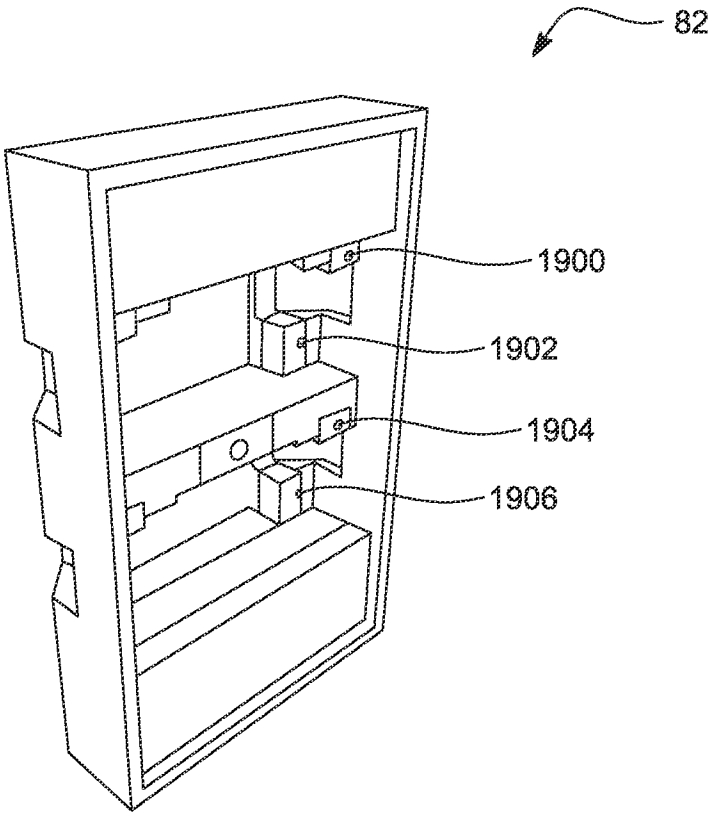
FIG. 50 is another schematic of the front cover plate of FIG. 47.
Figure 51:
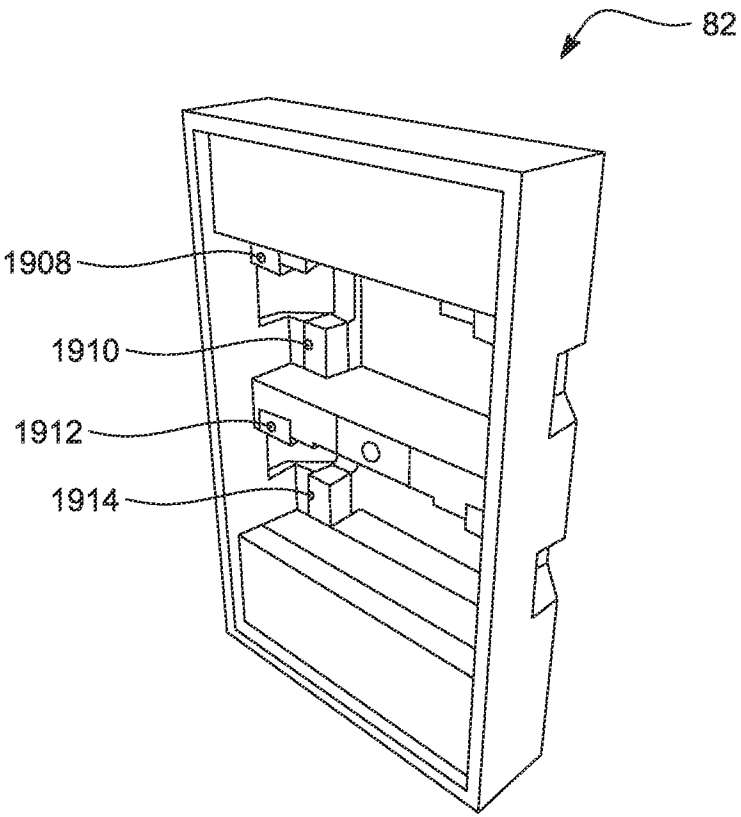
FIG. 51 is another schematic of the front cover plate of FIG. 47.

Referring to FIGS. 6, 7 and 47, the bolt 120 extends through the attachment bolt aperture 1020 (shown in FIG. 47) of the front cover plate 82, and the attachment bolt aperture 920 (shown in FIG. 45) of the rear support plate assembly 80, and through the threaded aperture 2200 of the wall outlet 24 (shown in FIG. 6) to couple the electrical plug retaining assembly 20 to the wall outlet 24.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. An electrical plug retaining assembly, comprising:

a first electrical plug socket adapted to receive first and second electrical prongs of a first electrical plug therein when first and second retaining arm assemblies in the first electrical plug socket are depressed, and to secure the first and second electrical prongs of the first electrical plug therein when first and second springs in the first electrical plug socket bias the first and second retaining arm assemblies, respectively, thereof in first and second directions, respectively, when the first and second retaining arm assemblies in the first electrical plug socket are not depressed; the first electrical plug socket having first and second electrical terminals that are electrically coupled to the first and second electrical prongs, respectively, of the first electrical plug;

a second electrical plug socket adapted to receive first and second electrical prongs of a second electrical plug therein when first and second retaining arm assemblies in the second electrical plug socket are depressed, and to secure the first and second electrical prongs of the second electrical plug therein when first and second springs in the second electrical plug socket bias the first and second retaining arm assemblies, respectively, thereof in the first and second directions, respectively, when the first and second retaining arm assemblies in the second electrical plug socket are not depressed; the second electrical plug socket having first and second electrical terminals that are electrically coupled to the first and second electrical prongs, respectively, of the second electrical plug;

a rear support plate assembly adapted to hold the first and second electrical plug sockets thereon such that the first and second electrical terminals of the first electrical plug socket extend therethrough, and the first and second electrical terminals of the second electrical plug socket extend therethrough; and a front cover plate being coupled to the rear support plate assembly to hold the first and second electrical plug sockets therebetween.

2. The electrical plug retaining assembly of claim 1, wherein:

the first electrical plug socket comprises:

a housing, first and second retaining arm assemblies, first and second springs, and first and second electrical terminals;

the housing having first and second grooves therein and first and second prong apertures extending therethrough;

the first electrical terminal having a first female terminal portion and a first male terminal portion coupled together, the first female terminal portion being disposed in the first groove and having first and second holes extending therethrough, the first male terminal portion extending outwardly from the housing, the first female terminal portion being aligned with the first prong aperture;

the second electrical terminal having a second female terminal portion and a second male terminal portion coupled together, the second female terminal portion being disposed in the second groove and having first and second holes extending therethrough, the second male terminal portion extending outwardly from the housing, the second female terminal portion being aligned with the second prong aperture;

the first retaining arm assembly being slidably disposed on the housing and extending over the first and second female terminal portions, the first retaining arm assembly having a first pin;

the first spring contacting the housing and the first retaining arm assembly and biasing the first retaining arm assembly in a first direction to move the first pin through the first and second holes of the first female terminal portion when the first retaining arm assembly is not depressed;

the second retaining arm assembly being slidably disposed on the housing and extending over the first and second female terminal portions, the second retaining arm assembly having a second pin; and the second spring contacting the housing and the second retaining arm assembly biasing the second retaining arm assembly in a second direction to move the second pin through the first and second holes of the second female terminal portion when the second retaining arm assembly is not depressed.

3. The electrical plug retaining assembly of claim 2, wherein:

the housing having a front wall, a rear wall, and a central support portion being coupled to and between the front wall and the rear wall;

the front wall having the first and second prong apertures extending therethrough;

the rear wall having the first and second male terminal portions extending therethrough; and the central support portion having the first and second grooves therein that are aligned and communicate with the first and second prong apertures, respectively.

4. The electrical plug retaining assembly of claim 3, wherein:

the first retaining arm assembly having a first finger tab portion, a first horizontal shaft portion, a first pin holding portion, and a first pin; the first horizontal shaft portion being coupled to and between the first finger tab portion and the first pin holding portion;

the first pin holding portion extending downwardly from the first horizontal shaft portion, the first pin being coupled to the first pin holding portion and extending toward the first finger tab portion; the first horizontal shaft portion being slidably disposed on the central support portion.

5. The electrical plug retaining assembly of claim 4, wherein:

the first spring contacting the housing and the first finger tab portion.

6. The electrical plug retaining assembly of claim 4, wherein:

the second retaining arm assembly having a second finger tab portion, a second horizontal shaft portion, a second pin holding portion, and a second pin; the second horizontal shaft portion being coupled to and between the second finger tab portion and the second pin holding portion; the second pin holding portion extending downwardly from the second horizontal shaft portion, the second pin being coupled to the second pin holding portion and extending toward the second finger tab portion; the second horizontal shaft portion being slidably disposed on the central support portion.

7. The electrical plug retaining assembly of claim 6, wherein:

the second spring contacting the housing and the second finger tab portion.

8. The electrical plug retaining assembly of claim 4, wherein:

the first electrical plug socket further comprises:

a prong hole cover member;

the central support portion having first and second cavities therein disposed adjacent to the front wall;

the prong hole cover member being slidably disposed on the central support portion and partially disposed in the first and second cavities; and a third spring contacting the prong hole cover member and the central support portion and biasing the prong hole cover member toward a first operational position such that the prong hole cover member covers a rear end of the first and second prong apertures of the housing when the second retaining arm assembly is not depressed to prevent first and second electrical prongs of an electrical plug from being inserted into the first and second prong apertures, respectively.

9. The electrical plug retaining assembly of claim 2, wherein:

the housing having a third groove therein and a third prong aperture extending therethrough; and a third electrical terminal having a third female terminal portion and a third male terminal portion coupled together, the third female terminal portion being disposed in the third groove, the third male terminal portion extending outwardly from the housing, the third female terminal portion being aligned with the third prong aperture.

10. An electrical plug socket, comprising:

a housing, first and second retaining arm assemblies, first and second springs, and first and second electrical terminals;

the housing having first and second grooves therein and first and second prong apertures extending therethrough;

the first electrical terminal having a first female terminal portion and a first male terminal portion coupled together, the first female terminal portion being disposed in the first groove and having first and second holes extending therethrough, the first male terminal portion extending outwardly from the housing, the first female terminal portion being aligned with the first prong aperture;

the second electrical terminal having a second female terminal portion and a second male terminal portion coupled together, the second female terminal portion being disposed in the second groove and having first and second holes extending therethrough, the second male terminal portion extending outwardly from the housing, the second female terminal portion being aligned with the second prong aperture;

the first retaining arm assembly being slidably disposed on the housing and extending over the first and second female terminal portions, the first retaining arm assembly having a first pin;

the first spring contacting the housing and the first retaining arm assembly and biasing the first retaining arm assembly in a first direction to move the first pin through the first and second holes of the first female terminal portion when the first retaining arm assembly is not depressed;

the second retaining arm assembly being slidably disposed on the housing and extending over the first and second female terminal portions, the second retaining arm assembly having a second pin; and the second spring contacting the housing and the second retaining arm assembly biasing the second retaining arm assembly in a second direction to move the second pin through the first and second holes of the second female terminal portion when the second retaining arm assembly is not depressed.

11. The electrical plug socket of claim 10, wherein:

the housing having a front wall, a rear wall, and a central support portion being coupled to and between the front wall and the rear wall;

the front wall having the first and second prong apertures extending therethrough;

the rear wall having the first and second male terminal portions extending therethrough; and the central support portion having the first and second grooves therein that are aligned and communicate with the first and second prong apertures, respectively.

12. The electrical plug socket of claim 11, wherein:

the first retaining arm assembly having a first finger tab portion, a first horizontal shaft portion, a first pin holding portion, and a first pin; the first horizontal shaft portion being coupled to and between the first finger tab portion and the first pin holding portion;

the first pin holding portion extending downwardly from the first horizontal shaft portion, the first pin being coupled to the first pin holding portion and extending toward the first finger tab portion; the first horizontal shaft portion being slidably disposed on the central support portion.

13. The electrical plug socket of claim 12, wherein:

the first spring contacting the housing and the first finger tab portion.

14. The electrical plug socket of claim 12, wherein:

the second retaining arm assembly having a second finger tab portion, a second horizontal shaft portion, a second pin holding portion, and a second pin; the second horizontal shaft portion being coupled to and between the second finger tab portion and the second pin holding portion; the second pin holding portion extending downwardly from the second horizontal shaft portion, the second pin being coupled to the second pin holding portion and extending toward the second finger tab portion; the second horizontal shaft portion being slidably disposed on the central support portion.

15. The electrical plug socket of claim 14, wherein:

the second spring contacting the housing and the second finger tab portion.

16. The electrical plug socket of claim 12, further comprising:

a prong hole cover member;

the central support portion having first and second cavities therein disposed proximate to the front wall;

the prong hole cover member being slidably disposed on the central support portion and partially disposed in the first and second cavities; and a third spring contacting the prong hole cover member and the central support portion and biasing the prong hole cover member toward a first operational position such that the prong hole cover member covers a rear end of the first and second prong apertures of the housing when the second retaining arm assembly is not depressed.

17. The electrical plug socket of claim 10, wherein:

the housing having a third groove therein and a third prong aperture extending therethrough; and a third electrical terminal having a third female terminal portion and a third male terminal portion coupled together, the third female terminal portion being disposed in the third groove, the third male terminal portion extending outwardly from the housing, the third female terminal portion being aligned with the third prong aperture.

* * * * *